US005850776A

United States Patent [19]

Takeuchi et al.

[11] Patent Number: 5,850,776

[45] Date of Patent: Dec. 22, 1998

[54] FLUID PRESSURE CYLINDERS PROVIDED WITH IMPACT ABSORBING MECHANISMS

[75] Inventors: Terumasa Takeuchi; Junji Mutsuura, both of Komaki, Japan

[73] Assignee: CKD Corporation, Japan

[21] Appl. No.: 838,506

[22] Filed: Apr. 8, 1997

[30] Foreign Application Priority Data

| | | | |
|---|---|---|---|
| Apr. 18, 1996 | [JP] | Japan | 8-096596 |
| Apr. 18, 1996 | [JP] | Japan | 8-096597 |
| Jun. 21, 1996 | [JP] | Japan | 8-161608 |
| Jun. 24, 1996 | [JP] | Japan | 8-163252 |
| Aug. 22, 1996 | [JP] | Japan | 8-221424 |

[51] Int. Cl.[6] ..... F01B 11/02

[52] U.S. Cl. ..... 92/85 R; 92/85 B; 92/143

[58] Field of Search ..... 92/85 R, 85 A, 92/85 B, 143

[56] References Cited

U.S. PATENT DOCUMENTS

| | | | |
|---|---|---|---|
| 2,998,288 | 8/1961 | Newhouse | 92/85 A |
| 3,465,650 | 9/1969 | Gluck | 92/85 R |
| 3,805,672 | 4/1974 | Pekrul | 92/85 R |
| 3,961,564 | 6/1976 | Rich et al. | 92/85 R |
| 4,431,172 | 2/1984 | Soda et al. | 92/85 A |
| 4,642,995 | 2/1987 | Bachler et al. | 92/85 R |
| 5,224,413 | 7/1993 | Herner . | |

FOREIGN PATENT DOCUMENTS

| | | | |
|---|---|---|---|
| 2355524 | 2/1977 | Germany | 92/85 R |
| 2712669 | 9/1978 | Germany | 92/85 R |
| 41 34 063 A1 | 4/1993 | Germany . | |
| 1401126 | 7/1975 | United Kingdom . | |

OTHER PUBLICATIONS

International Application Published under Patent Cooperation Treaty, Publication No. WO 90/14520, publication date Nov. 29, 1990.

*Primary Examiner*—Thomas E. Denion
*Attorney, Agent, or Firm*—Trask, Britt & Rossa

[57] ABSTRACT

A fluid pressure cylinder includes a cylinder body, a piston accommodated in the cylinder body to define first and second pressure chambers therein, means for supplying fluid to each chamber to reciprocate the piston between a first stroke end and a second stroke end, first and second bumper surfaces, an annular cushion retainer connected to the first bumper surface, and an elastomeric cushion for deforming and cushioning an impact produced when the piston reaches the first stroke end. The bumper surfaces approach each other when the piston reaches the first stroke end and separate from one another when the piston moves toward the second stroke end. The cushion has a shape corresponding generally to a hollow conical section. The cushion includes a base section retained by the cushion retainer and a buffer section joined to the base section. The buffer section has an outer surface for contacting the second bumper surface and an inner surface that faces the first bumper surface. The outer surface forms a circular seal with the second bumper surface when the piston approaches the first stroke end. The cushion is flexed such that the buffer section moves toward the first bumper surface. The buffer section moves away from the first bumper surface when the piston moves towards the second stroke end.

28 Claims, 20 Drawing Sheets

FLUID PRESSURE CYLINDERS PROVIDED WITH IMPACT ABSORBING MECHANISMS

BACKGROUND OF THE INVENTION

1. Field of the Invention

The present invention relates to fluid pressure cylinders provided with impact absorbing mechanisms.

2. Description of the Related Art

A typical fluid cylinder includes a piston and a cylinder cover. In such a cylinder, inertial force of the piston produces an impact between the piston and the cylinder cover when the piston is moved to its stroke end position. Thus, there is a need to absorb the inertial force of the piston and absorb the impact of the piston. Accordingly, several impact absorbing mechanisms have been proposed.

Japanese Unexamined Utility Model Publication No. 3-43139 describes a typical impact absorbing mechanism. As shown in FIG. 34, a fluid pressure cylinder 51 has a cylinder body 52 and a cylinder cover 53 closing each end of the body 52. A metal piston 55, which is connected to a rod 54, is slidably accommodated in the cylinder body 52. The piston 55 partitions and defines two pressure chambers 58, 59 in the cylinder 51. Cushions 56 are arranged between the inner surface of each cylinder cover 53 and the piston 55. Each cushion 56 has an annular basal portion 56*a*, which includes a center hole extending through the cushion 56 for the rod 54, and a lip 56*b*, which projects from one side of the basal portion 56*a*. The side of the basal portion 56*a* that does not have the lip 56*b* is fixed to the surface of the piston 55.

Air is drawn into the pressure chamber 59 through a port (not shown) to move the piston 55 to the right (as viewed in the drawing) until the cushion 56 abuts against the cylinder cover 53. As shown in FIG. 35(*a*), this results in an air pocket 60 being defined in the cylinder 51. As the piston 55 is further moved to the right and to its stroke end position, the lip 56*b* becomes elastically deformed. This presses the lip 56*b* against the surface of the base portion 56*a*. When the piston 55 reaches the stroke end position, the cushion 56 is entirely compressed by the piston 55. This stops the movement of the piston 55.

The volume of the air pocket 60 becomes smaller as the piston 55 approaches the stroke end position. Thus, the air in the air pocket 60 is compressed gradually. Accordingly, the impact of the piston 55, which is produced when the piston 55 is stopped, is absorbed by the resilient force of the cushion 56 and the reaction of the air in the air pocket 60 that acts against the piston 55.

However, in the above prior art cylinder, there is a tendency for stress to concentrate on the basal end of the lip 56*b* since the lip 56*b* projects from one side of the basal portion 56*a*. The concentration of stress causes early deterioration of the basal end of the lip 56*b* and may result in cracks in the cushion 56. Accordingly, it is difficult to maintain the capability of the cushions 56 to absorb impact over a long period.

Furthermore, in the prior art cylinder 51, the cushion 56 takes up a large space in the associated pressure chambers 58, 59. Hence, it is difficult to increase the compressing rate of the air in the air pocket 60. Accordingly, there is a need to provide a cushion 56 that has a higher impact absorbing capability.

SUMMARY OF THE INVENTION

Accordingly, it is an objective of the present invention to provide a fluid pressure cylinder that is provided with an impact absorbing mechanism having superior durability.

To achieve the above objective, the present invention provides a fluid pressure cylinder including a cylinder body having a closed space therein. A piston is slidably accommodated in the cylinder body to divide the closed space into first and second pressure chambers. A fluid supplying means supplies fluid to each chamber such that the piston reciprocates between a first stroke end and a second stroke end by receiving fluid in one of the first and second pressure chambers. A rod is connected to the piston. The rod extends from the cylinder body. The cylinder also has first and second bumper surfaces. One of the first and second bumper surfaces is fixed to the piston and the other is fixed to the cylinder such that the bumper surfaces face each other. The bumper surfaces approach each other when the piston reaches the first stroke end and separate from one another when the piston moves toward the second stroke end. The bumper surface that is fixed to the cylinder limits movement of the piston and determines the position of the first stroke end. An annular cushion retainer is connected to the first bumper surface. A ring-like, elastomeric cushion is located between the first and second bumper surfaces for deforming and cushioning an impact produced when the piston reaches the first stroke end. The cushion has a shape corresponding generally to a hollow conical section. The cushion includes a base section that is retained by the cushion retainer so that the cushion is retained in close proximity to the first bumper surface. A buffer section is joined to the base section. The buffer section is spaced from the first bumper surface. The buffer section has an outer surface for contacting the second bumper surface and an inner surface that faces the first bumper surface. The outer surface forms a circular seal with the second bumper surface when the piston approaches the first stroke end. The circular seal creates a fluid pocket that acts to further cushion the impact. The cushion is flexed such that the buffer section moves toward the first bumper surface against its elasticity when the piston approaches the first stroke end. The buffer section moves away from the first bumper surface due to its elasticity when the piston moves from the first stroke end towards the second stroke end.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

FIG. 33(*b*) is a partial enlarged cross-sectional view showing a fluid pressure cylinder according to a further embodiment;

DETAILED DESCRIPTION OF THE PREFERRED EMBODIMENTS

Figure 1:
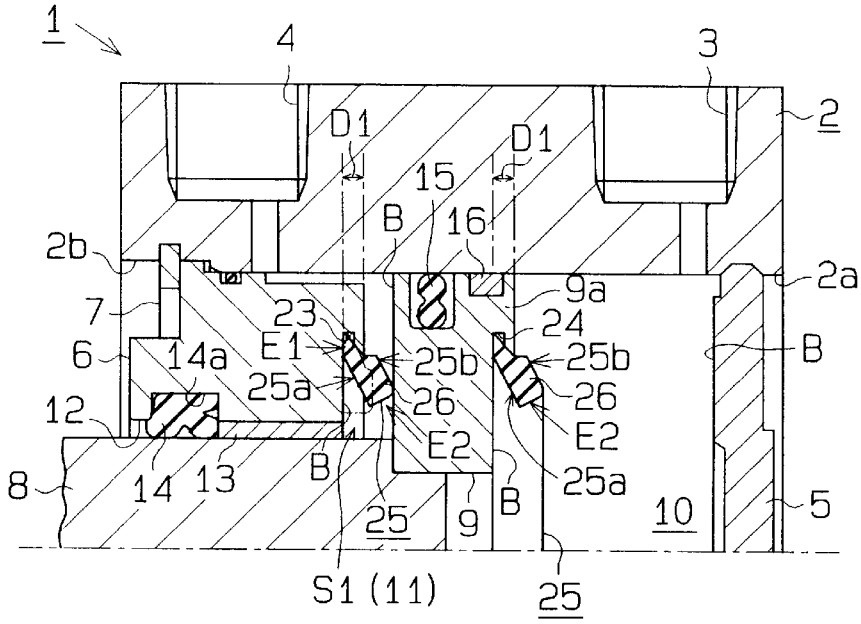
FIG. 1 is a partial cross-sectional view of a fluid pressure cylinder according to a first embodiment of the present invention.

A fluid pressure cylinder provided with an impact absorbing mechanism according to a first embodiment of the present invention will hereafter be described with reference to FIGS. 1 to 3. As shown in FIG. 1, a cylinder 1 includes a cylinder body 2, which is tubular and made of a metal material. The cylinder body 2 is provided with a first port 3 and a second port 4. An opening 2*a* of the cylinder body 2, which is located at the right side of the body 2 as viewed in FIG. 1, is closed by a metal head cover 5. An opening 2*b* of the cylinder body 2, which is located at the left side of the body 2, is closed by a metal rod cover 6. The terms "left" and "right" are used herein to indicate the leftward and rightward directions in the drawings.

The head cover 5 is fitted to the cylinder body 2 so that the cover 5 directly contacts the inner circumferential surface of the body 2. The rod cover 6 is fixed to the inner surface of the cylinder body 2 by a snap ring 7. A metal piston 9 is accommodated in the interior of the cylinder body 2 and supported so that it slides in the axial direction of the body 2. A metal rod 8 is coupled to the left side of the piston 9, as viewed in FIG. 1, coaxially to the cylinder body 2. The piston 9 partitions the interior of the cylinder body 2 and defines two pressure chambers 10, 11.

The pressure chamber 10 located at the head side of the piston 9 is defined between the inner surface of the head cover 5, the inner surface of the cylinder body 2, and the right surface of the piston 9. The first port 3 is communicated with the pressure chamber 10. The pressure chamber 11 located at the rod side of the piston 9 is defined between the inner surface of the rod cover 6, the inner surface of the cylinder body 5, the left surface of the piston 9, and the peripheral surface of the rod 8. The second port 4 is communicated with the pressure chamber 11.

The distal end of the rod 8 projects outward from the cylinder body 2 through a rod hole 12, which is formed in the center of the rod cover 6. A bearing 13 is arranged between the walls of the rod hole 12 and the rod 8 to decrease sliding resistance produced therebetween. A groove 14*a* is defined in the wall of the rod hole 12 located at a position that is closer to the distal end of the rod 8 than the bearing 13. An annular rod packing 14 is arranged in the groove 14*a* to seal the space between the peripheral surface of the rod 8 and the walls of the rod hole 12. A piston packing 15 and a piston ring 16, which are arranged in the peripheral surface of the piston 9, slide against the inner surface of the cylinder body 2.

Figure 3A:
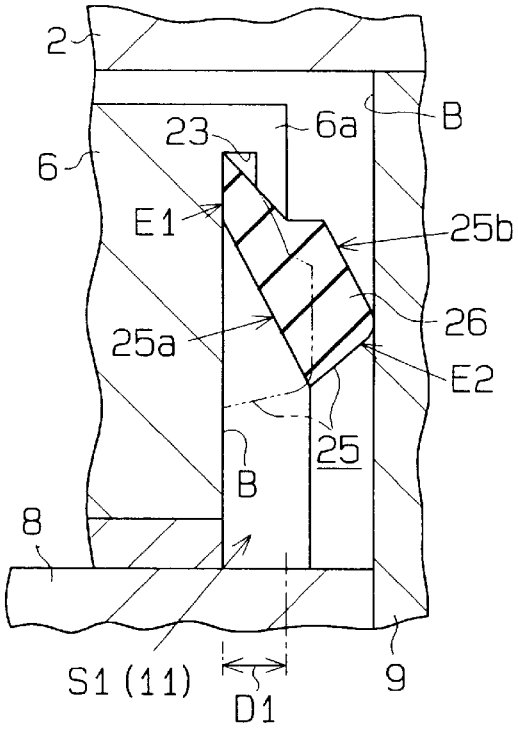
FIGS. 3(*a*) and 3(*b*) are enlarged cross-sectional views showing the operation of the cushion of FIGS. 2(*a*) to 2(*c*)
Figure 3B:
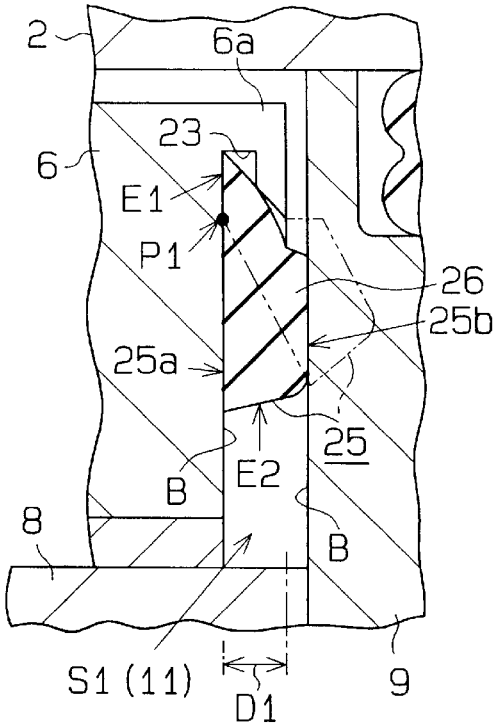

With reference to FIGS. 3(*a*) and 3(*b*), an annular retainer ring 6*a* projects toward the piston 9 from the periphery of the right end of the rod cover 6. The axial length of the retainer ring 6*a* is indicated as D1. In the same manner, a retainer ring 9*a* (FIG. 1) projects from the periphery of the right surface of the piston 9. The axial length of the retainer ring 9*a* is equal to that of the retainer ring 6*a*, or equal to D1.

Annular retaining grooves 23, 24 extend along the inner circumferential surface of the retainer rings 6*a*, 9*a*, respectively. The retaining grooves 23, 24 are arranged so that they are continuous with the right surface of the rod cover 6 and the right surface of the piston 9. An annular elastic cushion 25 is fitted into each retaining groove 23, 24.

The cushions 25 used in this embodiment will now be described. Each cushion 25 is made of urethane rubber and has optimal elasticity. Rubber materials such as acrylonitorile butadiene rubber (NBR), hydrogenated acrylonitorile butadiene rubber (HNBR), and fluoro rubber may be used as the material of the cushions 25 in lieu of urethane rubber. In general, the cushion 25 takes the form of a hollow conical section.

Figure 2A:
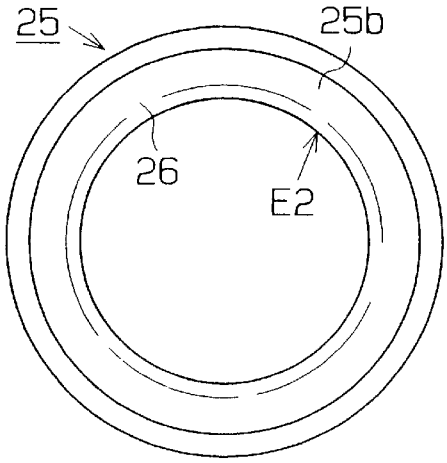
FIG. 2(*a*) is a plan view showing the cushion used in the cylinder of FIG. 1, FIG. 2(*b*) is a bottom view thereof, and FIG. 2(*c*) is a cross-sectional view thereof.
Figure 2B:
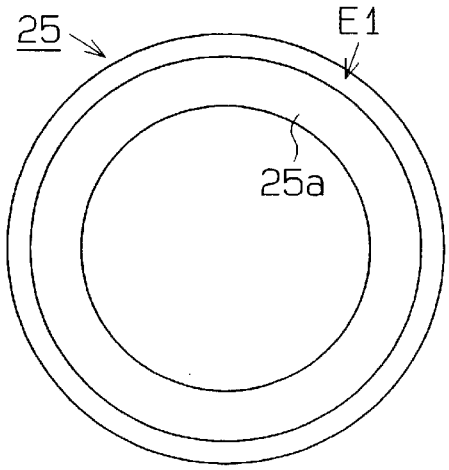
Figure 2C:
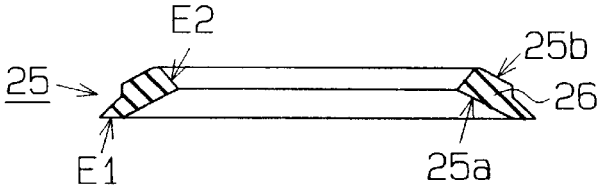

As shown in FIGS. 2(*a*) and 2(*b*), each cushion 25 includes a base portion E1, which is fit into the associated retaining groove 23, 24, and a buffer portion E2, or thick portion 26, which abuts against the left surface of the piston 9 or the inner surface of the head cover 5. The base portion E1 has a cross-section that resembles a knife edge. The buffer portion E2 is defined at the radially inner side of the base portion E1. The thickness of the buffer portion E2 is about two times the thickness of the base portion E1.

As shown in FIGS. 2(*a*), 2(*b*), and 3(*a*), the cushions 25 differ from the prior art cushions in that they are not provided with a lip. Accordingly, the cross-sectional shape of the cushions 25 is simple in comparison with that of the prior art cushions. The cross-section of the cushion 25 includes two parallel line segments 25*a*, 25*b* (FIG. 3*a*) and other line segments that connect the segments 25*a*, 25*b*. Among these line segments, the line segment 25*a* defines a plane that contacts the right surface of the rod cover 6 (or the right surface of the piston 9) when the piston 9 is moved to a stroke end position. This plane is referred to as an inner surface. The inner surface is conical when the cushion 25 is in its non-deformed state. In the same manner, the line segment 25*b* defines a plane that contacts the piston 9 (or the head cover 5) when the piston 9 is moved to the other stroke end position. This plane is referred to as an outer surface. The outer surface is conical when the cushion 25 is in its non-deformed shape.

As shown in FIG. 3(*a*), in the left pressure chamber 11, the base portion E1 of the cushion 25 makes planar contact with an inclined inner wall of the retaining groove 23 and the right surface of the rod cover 6, which is continuous from the inner wall of the groove 23, when the cushion 25 is held in the retaining groove 23 of the rod cover 6. In this state, the buffer portion E2 is separated from the right surface of the rod cover 6 and opposed to the left surface of the piston 9.

Figure 4:
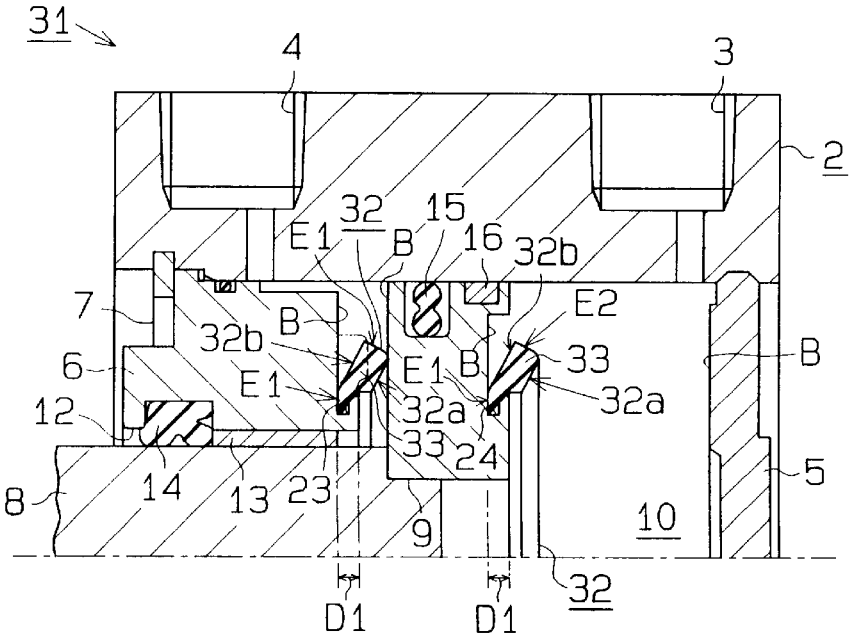
FIG. 4 is a partial cross-sectional view of a fluid pressure cylinder according to another embodiment.

As shown in FIG. 4, in the right pressure chamber 10, the base portion E1 of the cushion 25 is in planar contact with an inclined inner wall of the retaining groove 24 and the right surface of the piston 9, which is continuous from the inner wall of the groove 24, when the cushion 25 is held in the retaining groove 24 of the piston 9. In this state, the buffer portion E2 is separated from the right surface of the piston 9 and opposed to the inner surface of the head cover 5.

The surfaces of the piston 9, the head cover 5, and the rod cover 6 that contact the cushions 25 are herein referred to as bumper surfaces B.

FIG. 3(*a*) shows the piston 9 located between the stroke end positions. Thus, neither cushion 25 is compressed. In this state, the buffer portion E2 of each cushion 25 is inclined thirty degrees with respect to a radial line.

If the piston 9 is located at one of the two stroke end positions as shown in FIG. 3(*b*), the bumper surfaces B apply pressure to the associated cushion 25. This bends the base portion E1 and flexes the entire cushion 25 in a radially inward direction.

The section of the buffer portion E2 where the thickness becomes maximum is slightly greater than the length D1 of the retainer rings 6*a*, 9*a*. Accordingly, when the piston 9 moves to the stroke end position and impacts the cushion 25, the inertial force of the piston 9 compresses the cushion 25 axially. However, since the thickness of the cushion 25 is greater than the length of the retainer rings 6*a*, 9*a*, the piston 9 stops at its stroke end position without contacting the associated rod cover 6 or head cover 5 regardless of the deformation of the cushion 25.

The movement of the fluid pressure cylinder 1 and the operation of the cushions 25 will now be described. There is no difference between the rod side cushion 25 and the head side cushion 25. Thus, the following description will be centered only on the rod side cushion 25 shown in FIGS. 3(*a*) and 3(*b*).

Air is drawn into the pressure chamber 10 through the first port 3 when the piston 9 is located at the head side (right side as viewed in FIG. 1) stroke end position. This increases the pressure in the chamber 10 and causes the piston 9 and the rod 8 to move left and toward the rod cover 6. The movement of the piston 9 causes the air in the pressure chamber 11 to be discharged from the cylinder 1 through the second port 4.

As the piston 9 approaches the left stroke end position, the left surface of the piston 9 abuts against the buffer portion E2 of the cushion 25, as shown in FIG. 3(*a*). In this state, the cushion 25 partitions the pressure chamber 11 into two spaces, one radially inward of the cushion 25 and one radially outward of the cushion 25. The space defined outward of the cushion 25 is connected with the second port 4. The space defined at the inner side of the cushion 25 is disconnected from the second port 4. Air is sealed in the disconnected space, which is defined between the inner surface of the cushion 25, the left surface of the piston 9, the inner surface of the rod cover 6, and the peripheral surface of the rod 8. The disconnected space defines an air pocket S1.

As the piston 9 moves further slightly to the left and toward the stroke end position from the position shown in FIG. 3(*a*), the pressing force of the piston 9 causes elastic deformation of the cushion 25. This flexes the base portion E1 and moves the buffer portion E2 toward the right surface of the rod cover 6. Since the cushion 25 is an elastic body, the resilient force of the cushion 25 acts to restore the shape of the cushion 25. Thus, the resilient force of the cushion 25 acts against the piston 9. Accordingly, the inertial force of the piston 9 is offset by the resilient force. Thus, the impact force is absorbed.

When the cushion 25 is flexed, the deformation of the cushion 25 occurs from a boundary P1 that lies between the base portion E1 and the buffer portion E2. As the cushion 25 is deformed, the contact area between the cushion 25 and the rod cover 6 increases. This, in turn, enhances the seal between the cushion 25 and the rod cover 6.

The deformation of the cushion 25 increases until the piston 9 reaches the stroke end position. When the piston 9 is located at the stroke end position, the inner surface 25*a* of the cushion 25 abuts against the inner surface of the rod cover 6, as shown in FIG. 3(*b*). Further movement of the piston 9 compresses the cushion 25. After compression of the cushion 25, the resilient force produced by the compression acts to move the piston 9 back in a direction opposite the moving direction of the piston 9. This results in the inertial force of the piston 9 being offset by the resilient force of the cushion 25. Accordingly, the force of the impact is absorbed.

When the piston 9 moves from the position shown in FIG. 3(*a*) to the position shown in FIG. 3(*b*), the volume of the air pocket S1 becomes smaller in accordance with the movement of the piston 9. The gradual compression of the air in the air pocket S1 increases the reaction force of the air with respect to the piston 9. This adds to the absorption of the impact force applied to the piston 9.

When the piston 9 reaches the stroke end position shown in FIG. 3(*b*), the impact force of the piston 9 is absorbed sufficiently. The piston 9 is stopped and is prevented from coming into contact with the rod cover 6.

The merits of this embodiment will now be described. Each cushion 25 in the cylinder 1 is shaped and positioned so that the entire cushion 25 is flexed during absorption of impact. The stress produced during deformation of the cushion 25 is dispersed throughout the cushion 25. Thus, the cushion 25 of this embodiment differs from the prior art cushion having lips in that stress is not concentrated at certain locations. Furthermore, concentration of stress does not occur during compression of the cushion 25. Accordingly, early deterioration caused by stress concentration is positively prevented. This enables production of a superior cylinder 1 that allows absorption of impact over a long term.

In this embodiment, the air pocket S1 is defined at the flexing side of the cushion 25, or the inner side of the cushion 25. This prevents air from escaping the air pocket S1. Accordingly, the compression of air is positively carried out. This produces a sufficient magnitude of reaction force and enhances the impact absorbing capability of the cushion 25.

The annular shape of each cushion 25 allows the cushion 25 to be easily fit into the retaining grooves 23, 24 and enables the air pocket Sl to be easily defined in the cylinder body 2. Furthermore, the shape of the base portion E1 differs from the shape of the buffer portion E2. Thus, corrugations that may be produced in the cushion 25 by deformation are less in comparison with cushions that have a uniform shape. That is, the cushion 25 deforms relatively uniformly.

The cushions 25 are loosely fit into the retaining grooves 23, 24. This structure further suppresses stress concentration in comparison with cushions that are anchored with an adhesive agent. Thus, the durability of the cushions 25 is improved. Additionally, the base portion E1 of the cushion 25 need not be fixed to other parts. This facilitates the installation of the cushion 25.

As shown in FIG. 2(*c*), the cushion 25 has a relatively simple cross-section. Thus, the production of the cushion 25 is more simple than the prior art cushions. For example, if a mold is used to form the cushion 25, the shape of the mold is simple and the removal of the part from the mold is facilitated.

When the piston 9 reaches the stroke end position, the piston 9 does not come into direct contact with the head cover 5 and the rod cover 6. This reduces noise in comparison with prior art pistons.

This embodiment may be modified as described below.

An orifice may be provided in the rod cover 6 to communicate the air pocket S1 defined at the inner side of the cushion 25 with the atmosphere. The restriction of the orifice may be set to optimally adjust the impact absorbing characteristics.

Figure 5A:
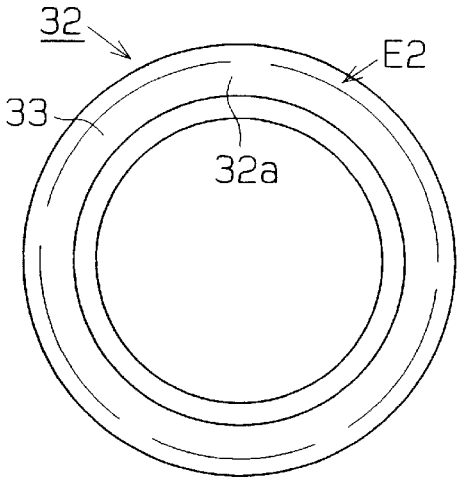
FIG. 5(*a*) is a plan view showing the cushion used in the cylinder of FIG. 4, FIG. 5(*b*) is a bottom view thereof, and FIG. 5(*c*) is a cross-sectional view thereof.
Figure 5B:
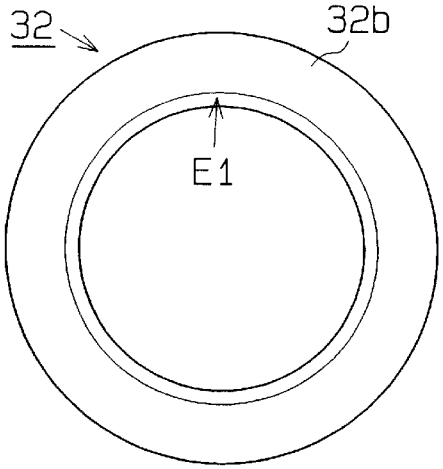
Figure 5C:
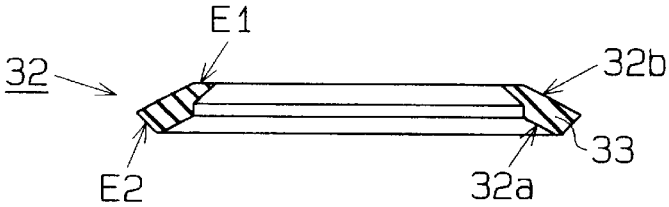
Figure 6A:
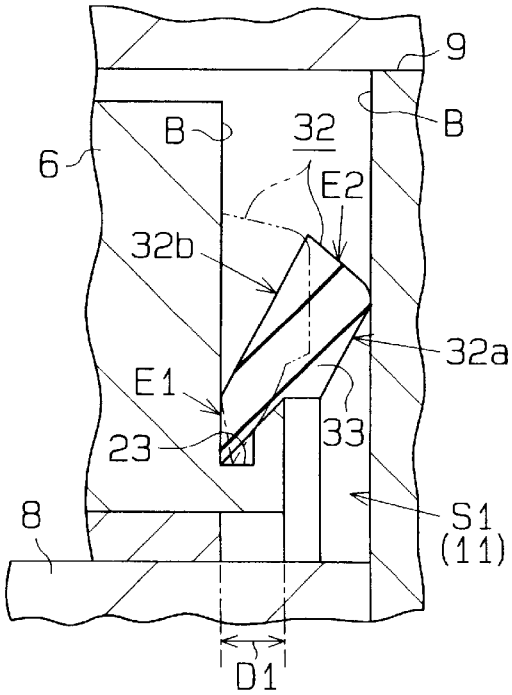
FIGS. 6(*a*) and 6(*b*) are enlarged cross-sectional views showing the operation of the cushion of FIGS. 5(*a*) to 5(*c*)
Figure 6B:
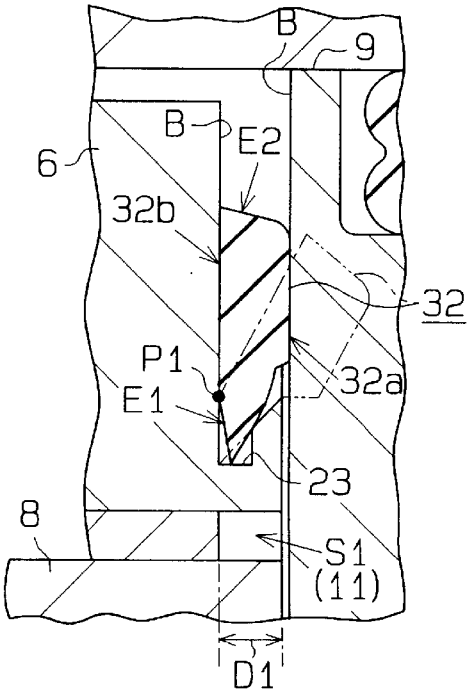

FIGS. 4 to 6 show a fluid pressure cylinder 31 of a further embodiment. The cylinder 31 employs a cushion 32 that has a structure differing from the cushion 25 employed in the first embodiment. The cushion 32 has a thick portion 33, which is defined at the radially outer part of the cushion 32. The base portion E1 is defined at the radially inner part of the cushion 32 and the buffer portion E2 is defined at the radially outer part of the cushion 32.

The cross-section of the cushion 32 includes two parallel line segments 32*a*, 32*b* and other line segments that connect the segments 32*a*, 32*b*. Among these line segments, the line segment 32*b* defines a plane that contacts the right surface of the rod cover 6 (or the right surface of the piston 9) when the piston 9 is moved to a stroke end position. This surface is referred to as an inner surface 32*b*. In the same manner, the line segment 32*a* defines a plane that contacts the piston 9 (or the head cover 5) when the piston 9 is moved to the other stroke end position. This plane is referred to as an outer surface 32*a*.

Accordingly, when the piston 9 moves to the stroke end position, the entire buffer portion E2 is flexed. In this state, an air pocket S1 is defined inward of the buffer portion E2. In this cylinder, the retaining groove 23 is located closer to the axis of the cylinder 32 than the retaining grooves in the embodiment of FIG. 1. The merits of the embodiment of FIG. 1 may also be obtained with the embodiment of FIG. 4.

Figure 7:
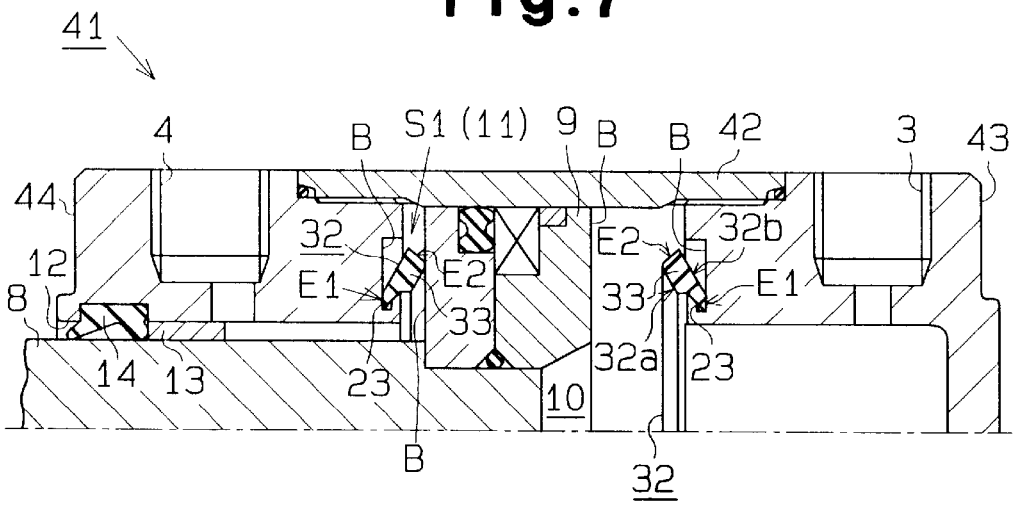
FIG. 7 is a partial cross-sectional view of a fluid pressure cylinder according to a further embodiment.

FIG. 7 shows a fluid pressure cylinder 41 of a further embodiment. The cylinder 41 has a head cover 43 that closes the right end of the cylinder body 42. A first port 3 is provided in the head cover 43. A rod cover 44 closes the left end of the cylinder body 42. The rod cover 44 is provided with a second port 4. This embodiment differs from the previous embodiments in that the cushions 32 are loosely fit into supporting grooves 23 that are defined in the covers 43, 44.

In this embodiment, the first and second ports 3, 4 are communicated with the inner side of the cushions 32 through the associated pressure chambers 10, 11. This results in the air pockets S1 being defined at the outer side of the cushions 32. This embodiment has the same advantages as the previous embodiments.

Figure 8A:
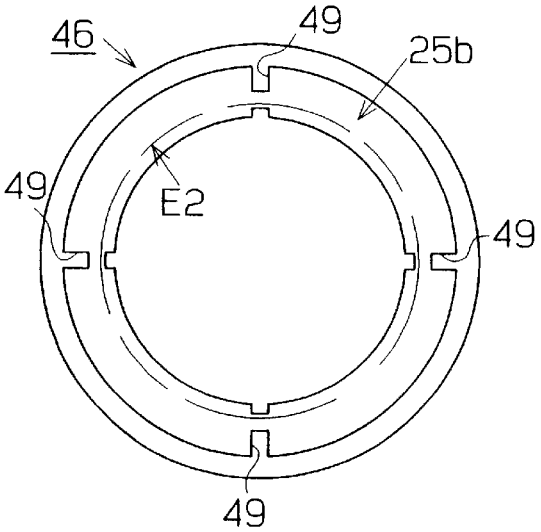
FIG. 8(*a*) is a plan view showing the cushion used in the cylinder of FIG. 7, FIG. 8(*b*) is a bottom view thereof, and FIG. 8(*c*) is a cross-sectional view thereof.
Figure 8B:
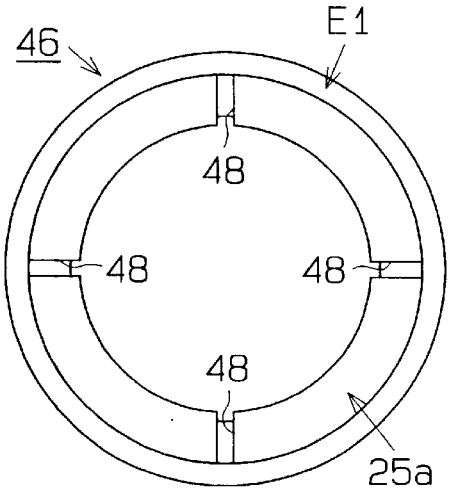
Figure 8C:
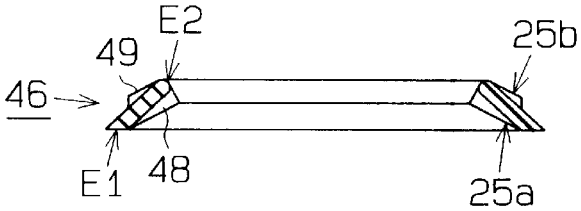

FIGS. 8(*a*), 8(*b*), and 8(*c*) show a cushion 46 of a further embodiment. Slits 48, 49 are provided in the cushion 46, which is otherwise the same as the cushion 25 of the first embodiment. The four inner slits 48 are provided in the inner surface 25*a* of the buffer portion E2 with an angular interval of 90 degrees between one another. The four outer slits 49 are provided in the outer surface 25*b* of the buffer portion E2 and are radially aligned with the inner slits 48. Each slit 48, 49 extends in the radial direction of the cushion 46.

Accordingly, when the cushions 46 are flexed to absorb the impact force, deflections that occur in the buffer portion E2 between adjacent slits is accommodated by the slits 48, 49. This prevents the formation of corrugations in the cushion 46. Furthermore, a slight amount of air leaks through the slits 48, 49 from the air pocket S1. Thus, the noise produced is less than that produced in cylinders having completely sealed air pockets S1. The slits 48, 49 need not be provided in both inner and outer surfaces 25*a*, 25*b* of the buffer portion E2. That is, slits may be provided solely in the inner surface 25*a* or solely in the outer surface 25*b*.

Both retaining grooves 23, 24 may be provided in the piston 9. Furthermore, the cushions may be made of a synthetic resin other than rubber. Fluids that may be used in the cylinder include gases such as nitrogen, oxygen, carbon dioxide, argon, hydrogen, air, which is a mixture of the above gases, or any other fluid that has properties similar to the above gases.

A further embodiment according to the present invention will now be described with reference to FIGS. 9 to 11. To avoid a redundant description, like or same reference numerals are given to those components that are like or the same as the corresponding components of the first embodiment.

Figure 10A:
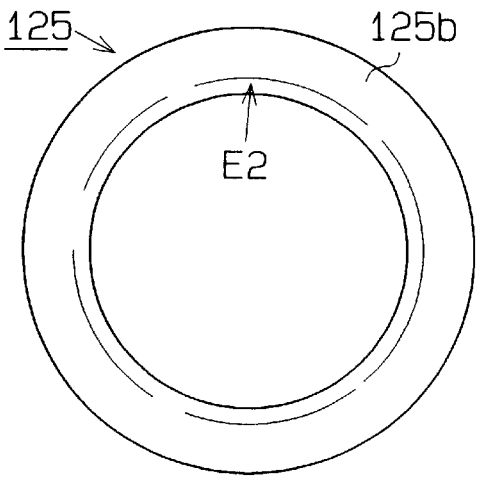
FIG. 10(*a*) is a plan view showing the cushion used in the cylinder of FIG. 9, FIG. 10(*b*) is a bottom view thereof, and FIG. 10(*c*) is a cross-sectional view thereof.
Figure 10B:
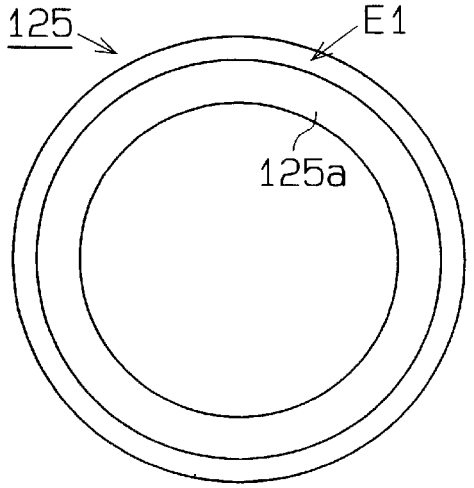
Figure 10C:
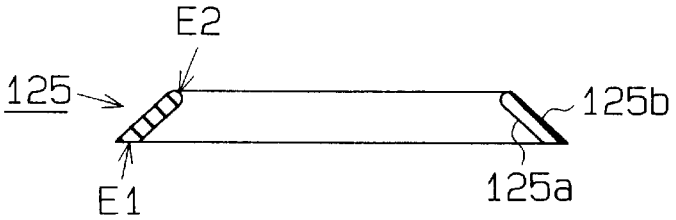

FIGS. 10(*a*), (*b*), and (*c*) show a cushion 125. Each cushion 125 is annular and has a uniform thickness. The cushion 125 includes a base portion E1 and a buffer portion E2. The base portion E1 has a cross-section that resembles a knife edge. The buffer portion E2 has a distal end, the cross-section of which is arched. The buffer portion E2 is located radially inward of the base portion E1.

Figure 9:
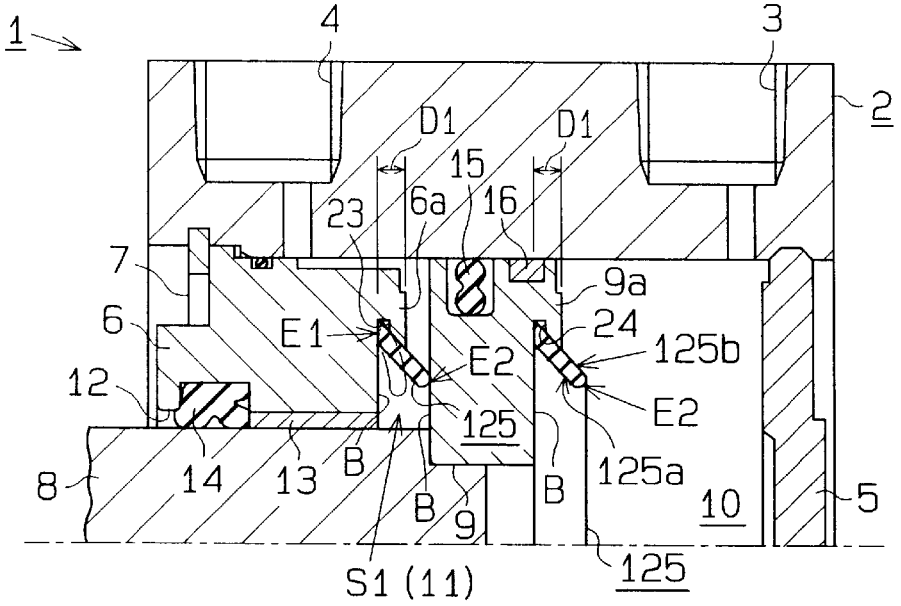
FIG. 9 is a partial cross-sectional view of a fluid pressure cylinder according to a further embodiment of the present invention.

As shown in FIG. 9, the base portion E1 of one of the cushions 125 is loosely fit into the retaining groove 23 of the rod cover 6 while the base portion E1 of the other cushion 125 is loosely fit into the retaining groove 24 of the piston 9. The section of the cushion 125 where the thickness becomes maximum is slightly smaller than the length D1 of the retainer rings 6*a*, 9*a*.

Figure 11:
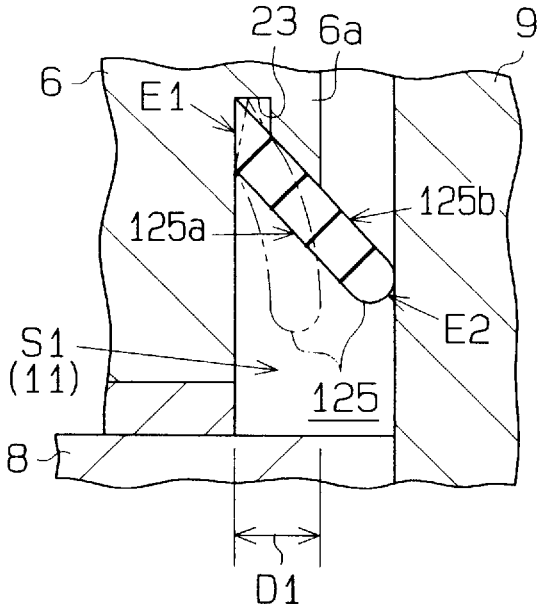
FIGS. 11(*a*) and 11(*b*) are enlarged cross-sectional views showing the operation of the cushion of FIGS. 10(*a*) to 10(*c*)
Figure 11:
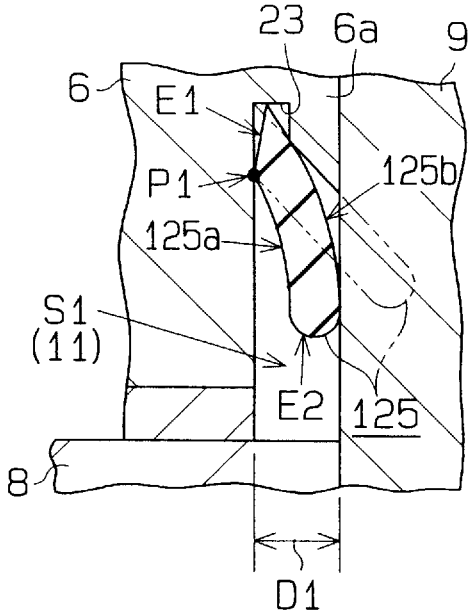

When the piston 9 is located midway between the stroke ends and pressure is not applied to the cushions 125 as shown in the states of FIGS. 9 and 11(*a*), the buffer portion E2 of each cushion 125 is inclined at an angle of about 45 degrees with respect to the associated surfaces of the rod cover 6 and piston 9. In this state, the buffer portions E2 project outward from the associated retainer rings 6*a*, 9*a*.

When the piston 9 is moved to the left stroke end position, as viewed in FIG. 11(*b*), the piston 9 is stopped as its left surface abuts against the retainer ring 6*a* of the rod cover 6. Prior to the abutment, the piston 9 comes into contact with the cushion 125 and arches the buffer portion E2 inward. The arching of the cushion 125 forms an air pocket S1 within the cushion 125.

Accordingly, in a manner similar to that of the first embodiment, the impact of the piston 9 is absorbed by the cushion 125 and the air pocket S1. Impact is absorbed in the same manner when the piston 9 moves to the right stroke end position.

Furthermore, the left stroke end position is determined by the contact between the rod cover 6 and the piston 9, which are both made of metal. In the same manner, the right stroke end position is determined by the contact between the metal head cover 5 and the piston 9. Accordingly, the positioning accuracy of piston 9 at the stroke end positions is enhanced in comparison with prior art cylinders.

Figure 12:
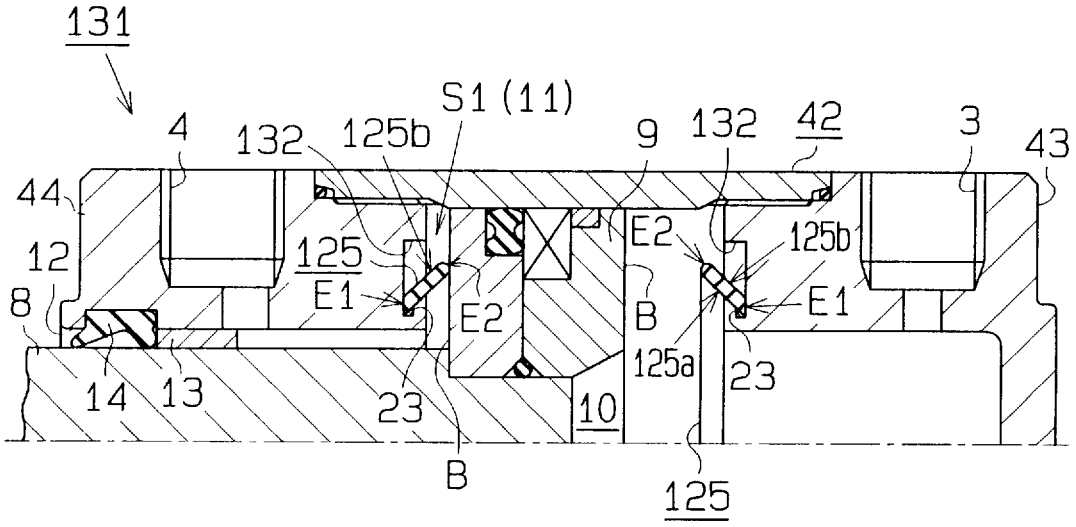
FIG. 12 is a partial cross-sectional view showing a fluid pressure cylinder according to a further embodiment.

FIG. 12 shows a further embodiment. This form employs a cylinder 131 that is identical to the cylinder 41 of FIG. 7. The cushion 125 of the second embodiment is used in the cylinder 131. More specifically, the cylinder 131 has a pair of cushions 125 that are each loosely fit in the retaining grooves 23 of the covers 43, 44. The retaining grooves 23 are provided in the inner walls of recesses 132, which are defined in the covers 43, 44.

When pressure is not applied, each cushion 125 projects toward the axially middle section of the cylinder 131 from the covers 43, 44. When the piston 9 moves to either one of the stroke end positions, which is determined by contact between the piston 9 and either one of the covers 43, 44, the cushion 125 occupies the associated recess 132. Accordingly, advantages of the first embodiment may also be obtained through this modified form.

Figure 13:
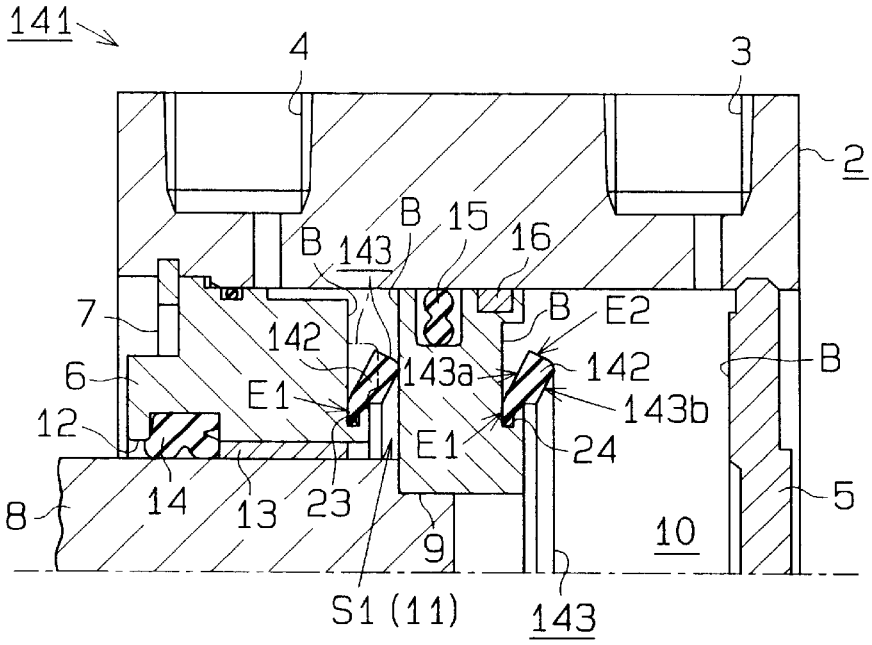
FIG. 13 is a partial cross-sectional view showing a fluid pressure cylinder according to a further embodiment.
Figure 14A:
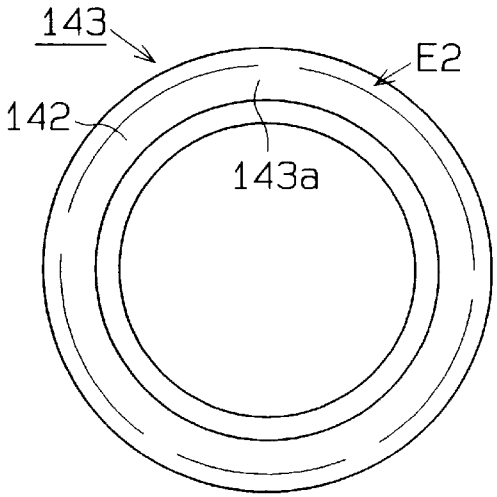
FIG. 14(*a*) is a plan view showing the cushion used in the cylinder of FIG. 13, FIG. 14(*b*) is a bottom view thereof, and FIG. 14(*c*) is a cross-sectional view thereof.
Figure 14B:
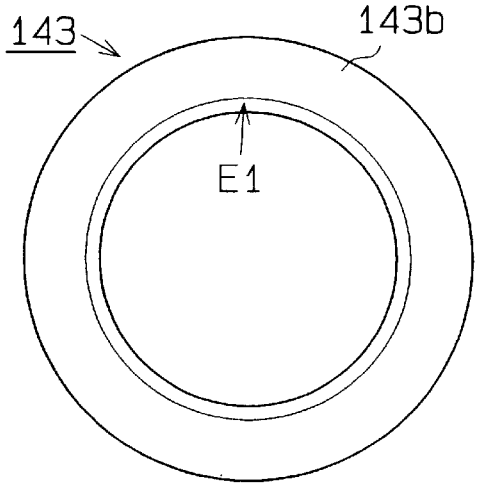
Figure 14C:
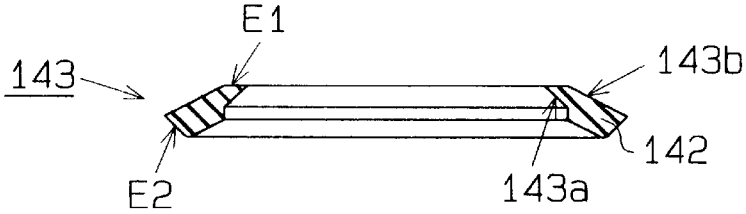
Figure 15A:
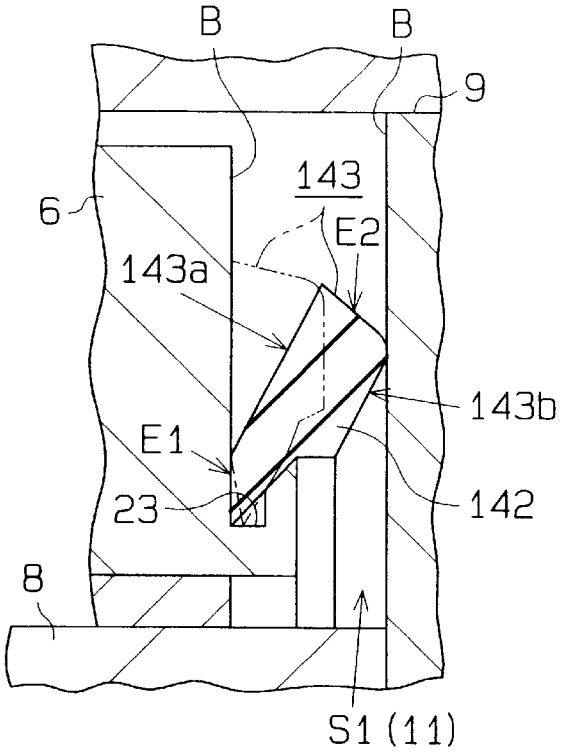
FIGS. 15(*a*) and 15(*b*) are enlarged cross-sectional views showing the operation of the cushion of FIGS. 14(*a*) to 14(*c*)
Figure 15B:
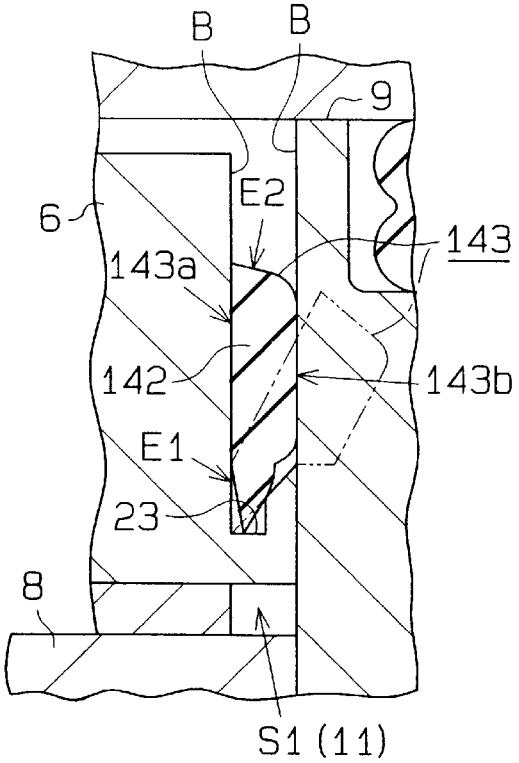

FIGS. 13, 14(*a*), 14(*b*), 14(*c*), 15(*a*), 15(*b*) show a further embodiment. This form employs a cylinder 141 that uses cushions 143, which are identical to the cushions 32 shown in FIG. 4. The cushions 143 are arranged so that the piston 9 abuts against either one of the covers 5, 6 at the stroke end position when the compression of the cushions 143 becomes maximum. Accordingly, the merits of the embodiment of FIG. 10 may also be obtained through this modified form.

Figure 16:
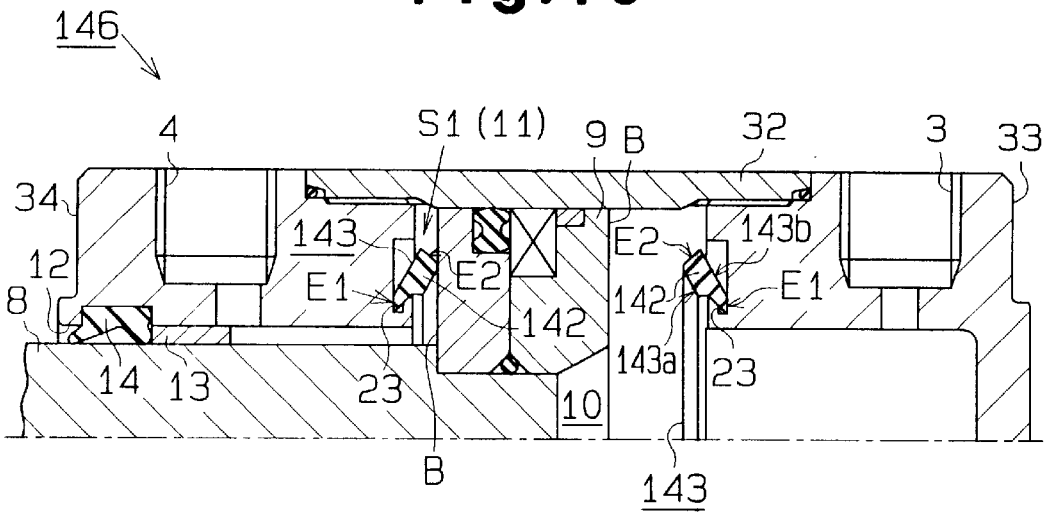
FIG. 16 is a partial cross-sectional view showing a fluid pressure cylinder according to a further embodiment.

FIG. 16 shows a further embodiment. This form employs a cylinder 146. In this cylinder 146, the cushion 131 used in the cylinder 131 of FIG. 12 is replaced by the cushion 142 having a thick portion, which is shown in FIG. 13. Accordingly, the merits of the embodiment of FIG. 10 may also be obtained through this modified form.

A further embodiment according to the present invention will now be described with reference to FIGS. 17 to 19. In this embodiment, a fluid pressure cylinder 201 has cushions 225 and retaining grooves 223, 224 that differ from the first embodiment. The differing parts will be described below.

Figure 17:
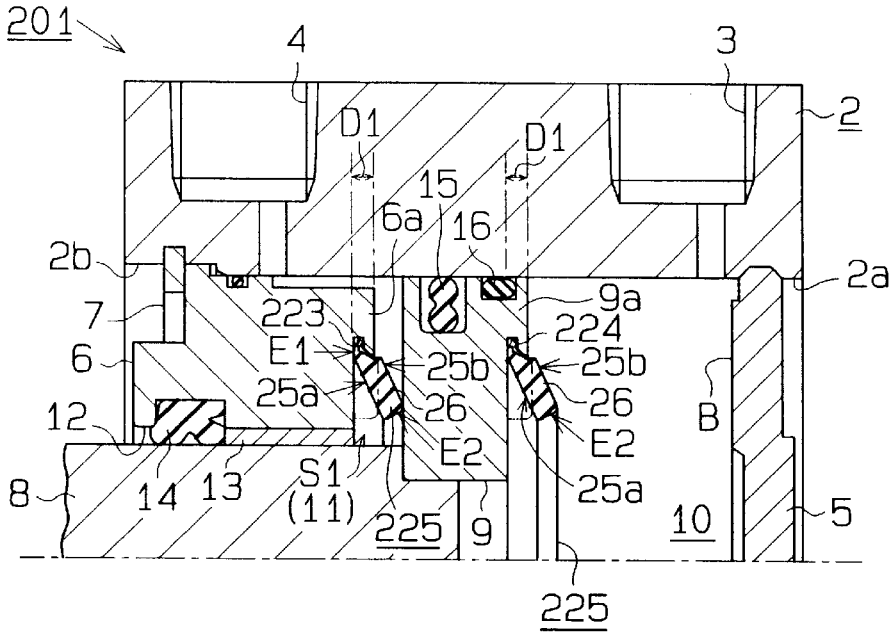
FIG. 17 is a partial cross-sectional view showing a fluid pressure cylinder according to a further embodiment of the present invention.
Figure 18A:
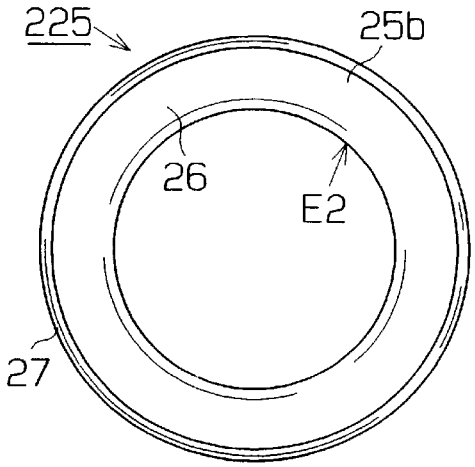
FIG. 18(*a*) is a plan view showing the cushion used in the cylinder of FIG. 17, FIG. 18(*b*) is a bottom view thereof, and FIG. 18(*c*) is a cross-sectional view thereof.
Figure 18B:
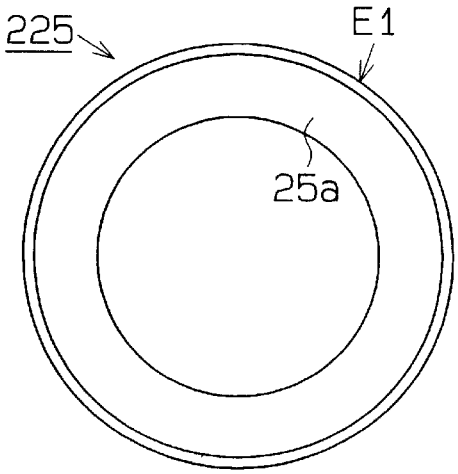
Figure 18C:
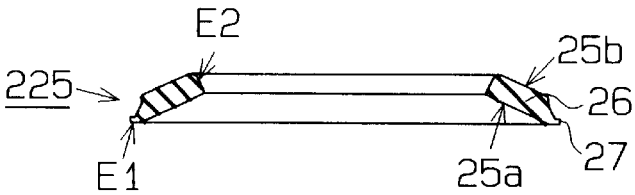
Figure 19:
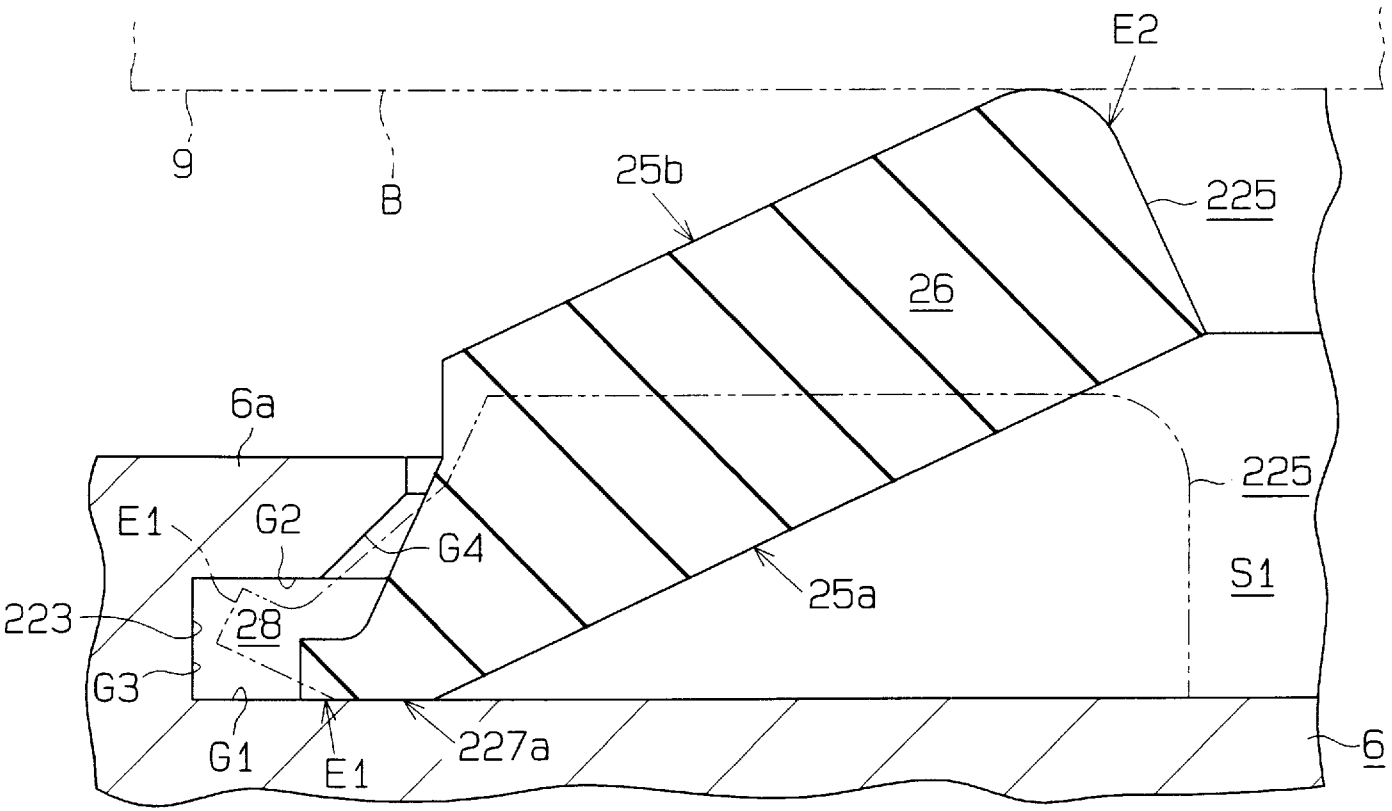
FIG. 19 is an enlarged partial cross-sectional view showing the operation of the cushion of FIGS. 18(*a*) to 18(*c*)

As shown in FIGS. 17 to 19, the retaining groove 223 extends along the inner surface of the retainer ring 6*a*, which projects from the rod cover 6. The retaining groove 224 extends along the inner surface of the retainer ring 9*a*, which projects from the piston 9. Each retaining groove 223, 224 includes a first wall G1 extending continuously from the right surface of the rod cover 6 or the piston 9, a second wall G2 opposed to the first wall G1, and a third wall G3 connecting the first and second walls G2, G3. The third wall G3 corresponds to the bottom surface of the grooves 223, 224.

An inclined (conical) surface G4 extends in the retainer ring 6*a* continuously from the second wall G2. The inclined surface G4 is inclined so that the width of the retaining groove 223 widens at locations closer to the piston 9. The retainer ring 9*a* of the piston 9 also includes an inclined surface (not shown) that is identical to the inclined surface G4.

Each cushion 225 includes a base portion E1, which is retained in either one of the retaining grooves 223, 224, and a buffer portion E2, or thick portion 26, which is thicker than the base portion E1. The thickness of the base portion E1 is about half the width of the retaining grooves 223, 224. The base portion E1 includes a sliding surface 227*a* that slides along the first wall G1 of the retaining grooves 223, 224.

As shown by the solid lines of FIG. 19, the first wall G1 of the retaining groove 223 comes into planar contact with the sliding surface 227*a* of the base portion E1 when the cushion 225 is attached to the retaining groove 223 of the rod cover 6. Additionally, a space 28 becomes defined in the retaining groove 223 to allow radially outward movement of the base portion E1. Furthermore, the buffer portion E2 is separated from the inner surface of the rod cover 6 and projects toward the piston 9.

In the same manner, attachment of the cushion 225 to the retaining groove 224 defines a space 28 for allowing movement of the base portion E1 in the retaining groove 224. The buffer portion E2 projects toward the head cover 5. Furthermore, the dimension of the space 28 is determined so that the base portion E1 moves radially but does not come into contact with the third wall G3 when the deformation of the cushion 225 becomes maximum.

When air is conveyed through the first port 3, the pressure in the pressure chamber 10 increases. This moves the piston 9 and the rod 8 to the left, as viewed in FIG. 17 and discharges air out of the pressure chamber 11 through the second port 4.

In the same manner as with the first embodiment, the left surface of the piston 9 abuts against the buffer portion E2 of the cushion 225 and flexes the cushion 225 before the piston 9 reaches the left stroke end position. The cushion 225 is gradually compressed afterward. The compression of the cushion 225 absorbs the inertial force of the piston 9 and thus absorbs the impact produced by the piston 9. This takes place in the same manner when the piston 9 is moved to the right stroke end position. During deformation of the cushion 225, the buffer portion E2 is compressed and the base portion E1 is expanded, or placed in tension.

The base portion E1 may be moved in a radially outward direction within the space 28 of the base portion E1 during elastic deformation of the cushion 225. This decreases resistance against deformation of the cushion 225 and avoids concentration of stress in the base portion E1. As a result, early deterioration caused by stress concentration is prevented and the durability of the cushion 225 is positively enhanced. Furthermore, the decrease in the deformation resistance of the cushion 225 enables the piston 9 to be driven efficiently under low pressure conditions.

Furthermore, the base portion E1 does not come into contact with the third wall G3 of the retaining grooves 223, 224 during elastic deformation of the cushion 225. Accordingly, resistance, which interferes with the movement of the base portion E1, caused by abutment with the third wall G3, is prevented.

Each retaining groove 223, 224 is provided with the inclined surface G4. This prevents the base portion E1 of the cushion 225 from abutting against cornered portions of the retaining grooves 223, 224. Thus, damage caused by such cornered portions is prevented. Furthermore, the inclined surface G4 facilitates insertion of grooving tools into the retaining grooves 223, 224. Accordingly, machining of the grooves 223, 224 becomes relatively simple.

Figure 20:
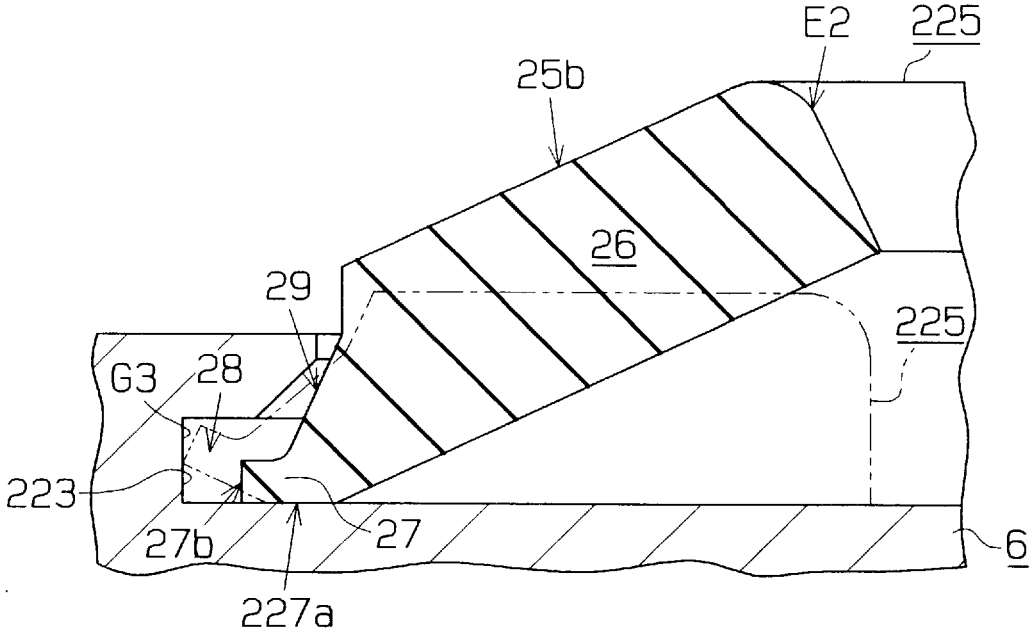
FIG. 20 is an enlarged partial cross-sectional view showing a fluid pressure cylinder according to a further embodiment.

This embodiment may be modified as described below. FIG. 20 shows a further embodiment. The dimension of the space 28 is determined so as to allow contact between the base portion E1 and the third wall G3 when the deformation of the cushion 225 becomes maximum. However, the structure of the embodiment of FIG. 17, in which the base portion E1 does not contact the third wall G3 at all, positively prevents concentration of stress and is thus preferred.

Figure 21:
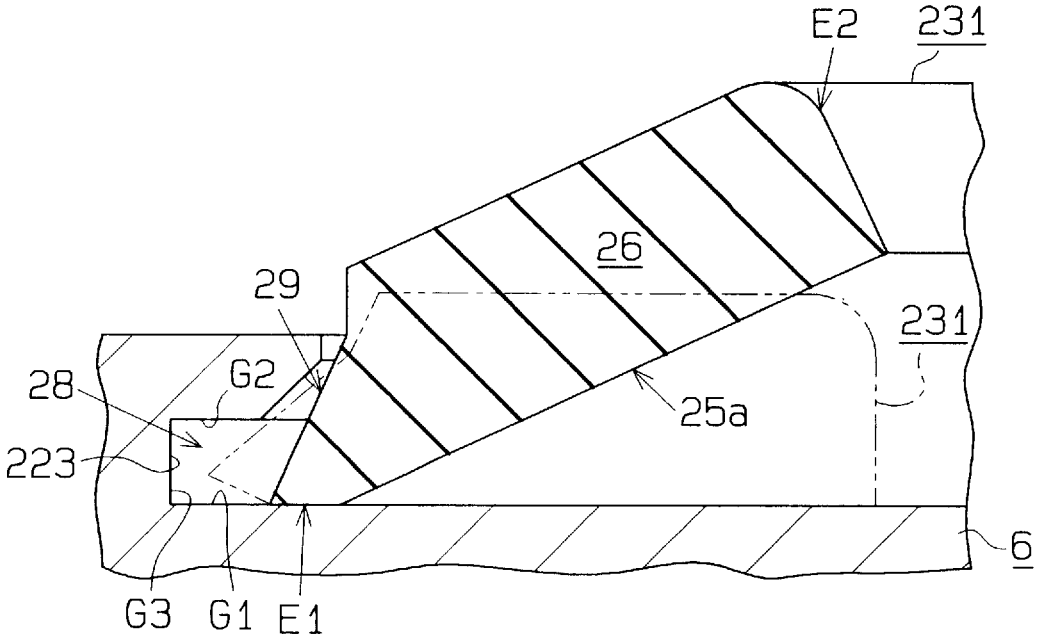
FIG. 21 is an enlarged partial cross-sectional view showing a fluid pressure cylinder according to a further embodiment.

The cross-sectional shape of the base portion E1 is not limited to the shape of the illustrated embodiments. For example, as shown in FIG. 21, a cushion 231 has a base portion E1 that is relatively smaller than that of the embodiment of FIG. 17. The cross-section of this base portion E1 does not include a rectangular portion. The merits of the embodiment of FIG. 17 are obtained with this form as well.

Figure 22:
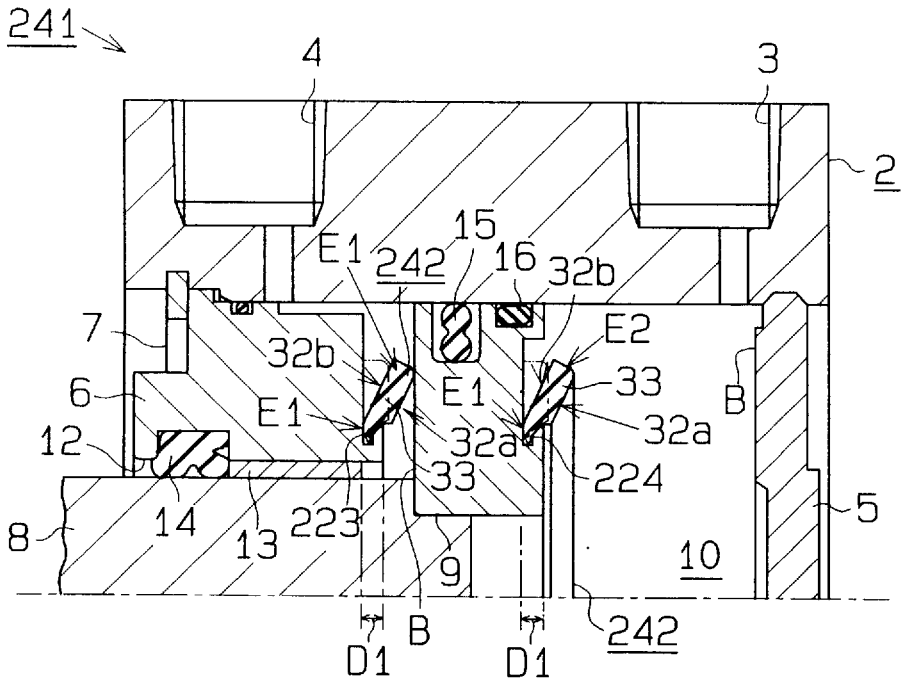
FIG. 22 is a partial cross-sectional view showing a fluid pressure cylinder according to a further embodiment.
Figure 23:
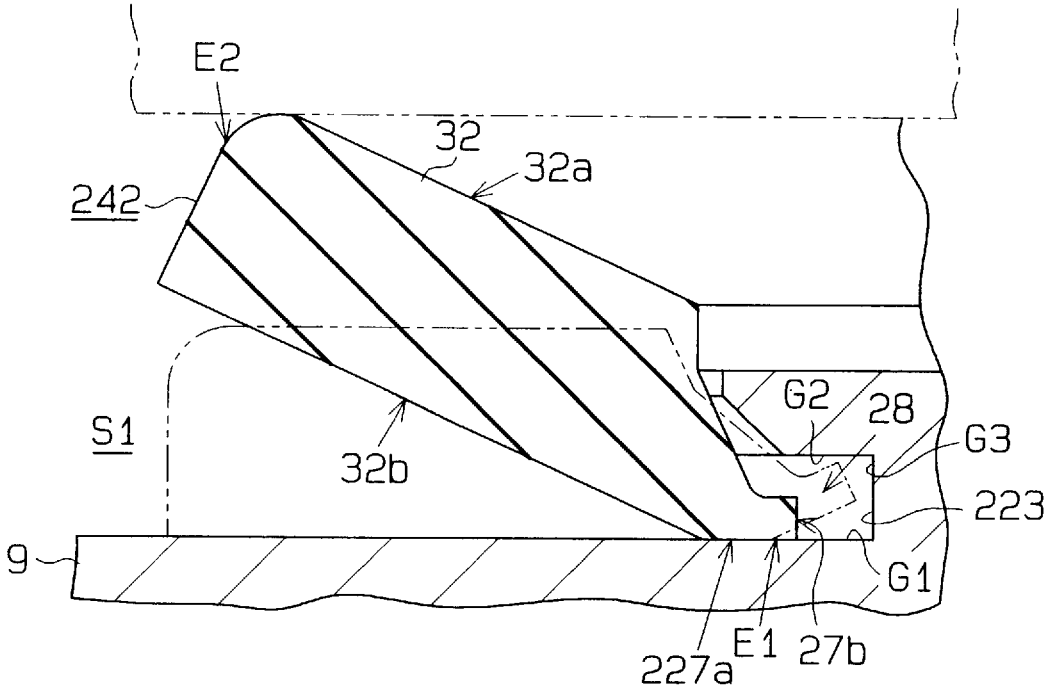
FIG. 23 is an enlarged partial cross-sectional view of the cylinder of FIG. 22.

FIGS. 22 and 23 show a further embodiment. A fluid pressure cylinder 241 employs a cushion 242 having substantially the same structure as the cushion 32 shown in FIG. 4. The base portion E1 of the cushion 242 is provided at the radially inner side of the buffer portion E2 (thick portion 32). Other parts are identical to the structure shown in FIG. 17. Accordingly, the merits of the embodiment of FIG. 17 are also obtained with this form.

Figure 24:
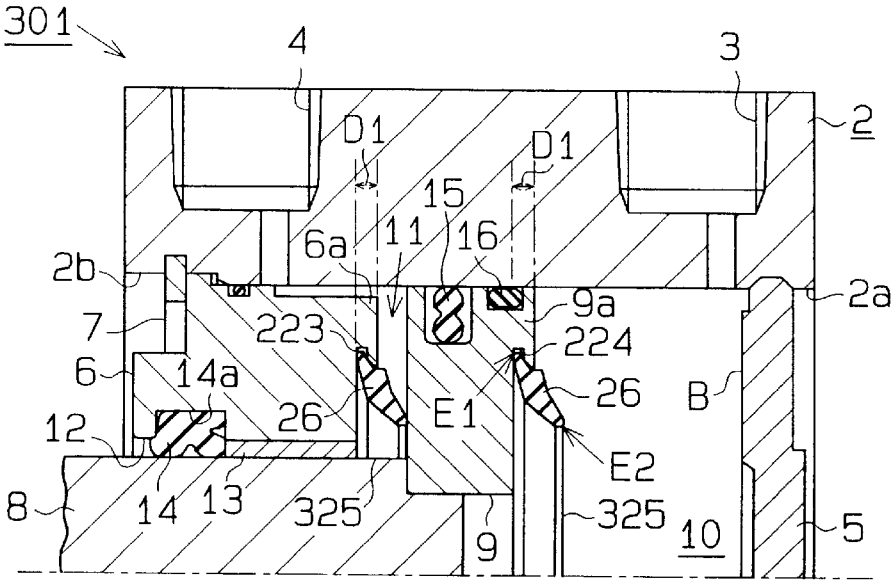
FIG. 24 is a partial cross-sectional view of a fluid pressure cylinder according to a further embodiment of the present invention.
Figure 25A:
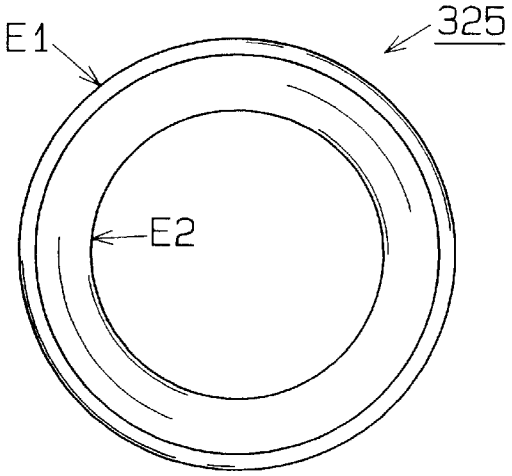
FIG. 25(*a*) is a plan view showing the cushion used in the cylinder of FIG. 24, FIG. 25(*b*) is a bottom view thereof, and FIG. 25(*c*) is a cross-sectional view thereof.
Figure 25B:
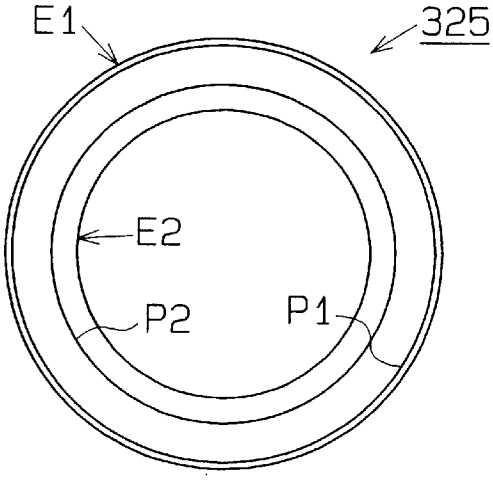
Figure 25C:
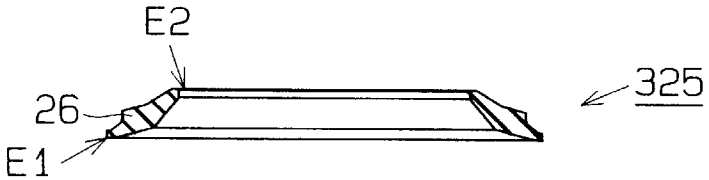

A further embodiment according to the present invention will now be described with reference to FIGS. 24, 25(*a*), 25(*b*), 25(*c*), 26, 27(*a*), 27(*b*), 27(*c*) and 27(*d*). In this embodiment, a cylinder 301 has a structure that differs from the structure of the embodiment shown in FIG. 17. The differing features will be described below.

A cushion 325 includes a base portion E1, which is fit into either one of the retaining grooves 223, 224 and a buffer portion E2, which extends toward the center of the cushion 325. The thickness of the base portion E1 is about three fourths (¾) the width of the retaining grooves 223, 224. The base portion E1 has a sliding surface 327*a* that comes into planar contact with the first wall G1 of either one of the retaining grooves 223, 224.

The buffer portion E2 includes first, second, and third sections E21, E22, E23. The first section E21 extends continuously from the base portion E1. The thickness of the first section E21 increases at positions closer to the center of the cushion 325. The second section E2 extends continuously from the first section E21 and has a uniform thickness. The third section E3 extends continuously from the second section E22 and has a thickness that decreases at positions closer to the center of the cushion 325. A first seal circle P1, which is concentric with the cushion 325, is defined between the base portion E1 and the first section E21 on the inner surface of the cushion 325. A second seal circle P2, which is concentric with the first seal circle P1 is defined between the second section E22 and the third section E23 on the inner surface of the cushion 325.

Figure 26:
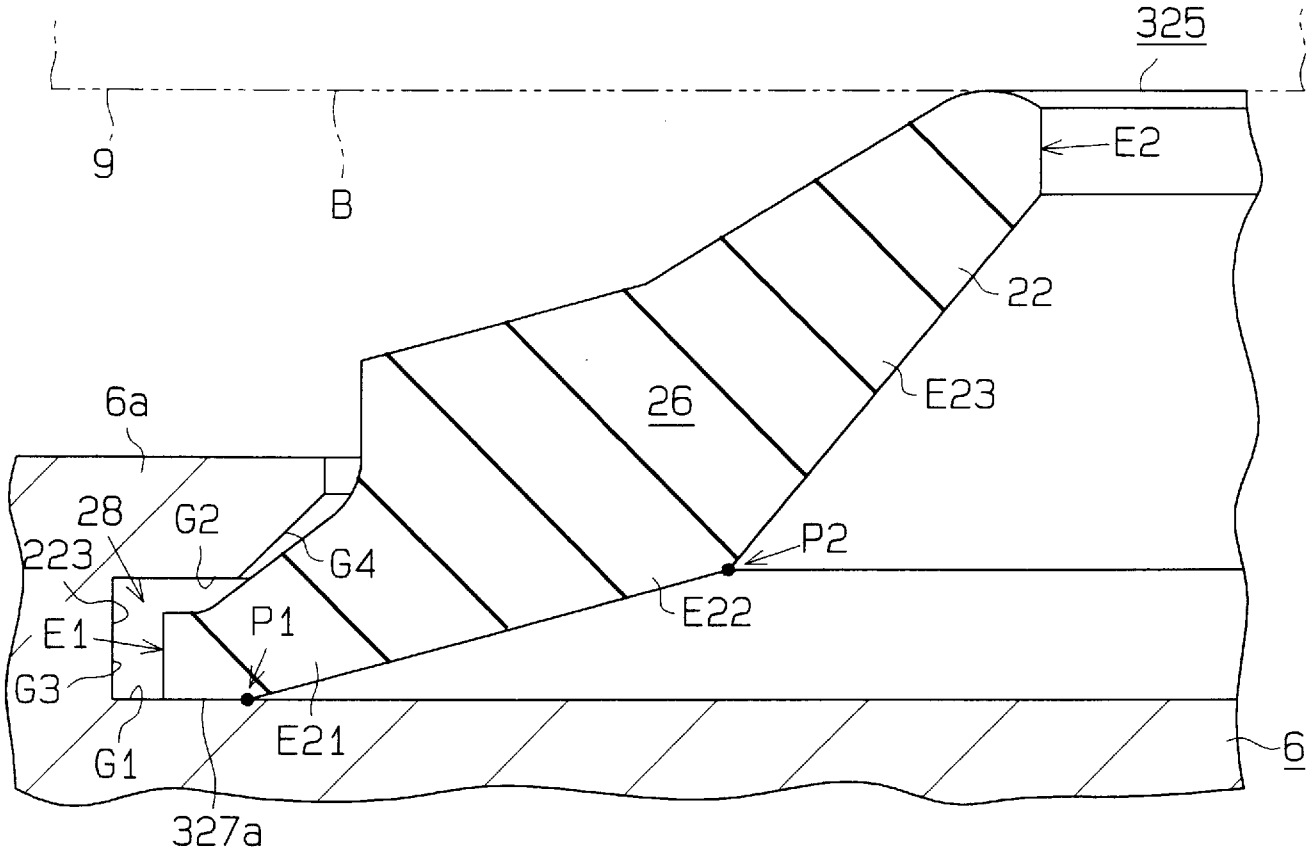
FIG. 26 is an enlarged cross-sectional view showing the operation of the cushion of FIGS. 25(*a*) to 25(*c*)
Figure 27A:
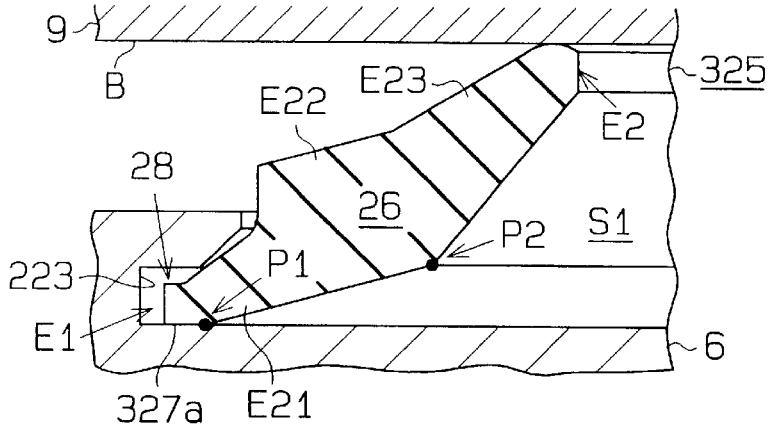
FIGS. 27(*a*), 27(*b*), 27(*c*), and 27(*d*) are partial cross-sectional views showing the operation of the cushion of FIGS. 25(*a*) to 25(*c*)
Figure 27B:
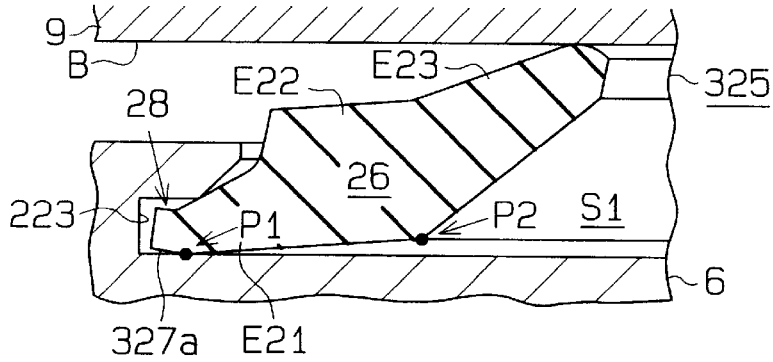
Figure 27C:
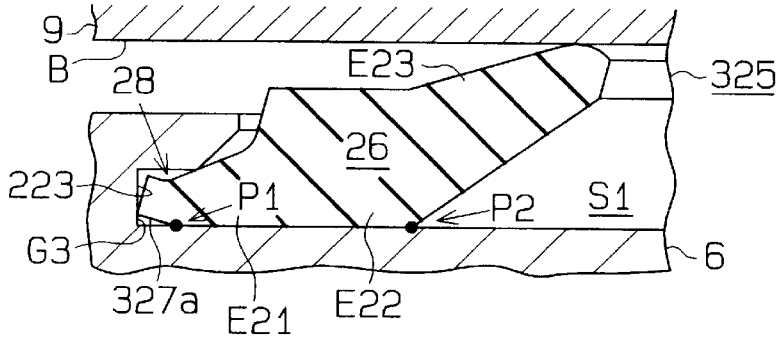
Figure 27D:
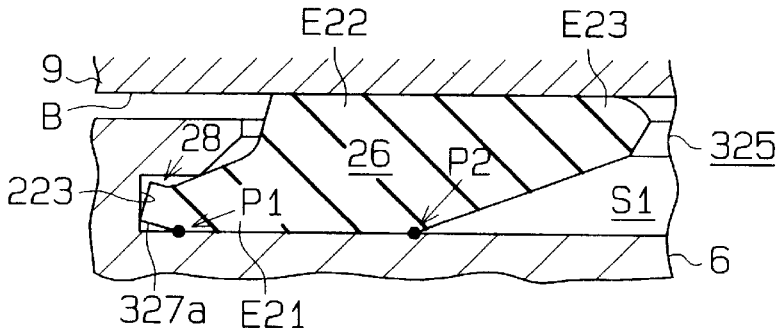

As shown in FIG. 26, the sliding surface 327*a* of the base portion E1 comes into planar contact with the first wall G1 of the retaining grooves 223, 224 when the cushion 325 is attached to either one of the retaining grooves 223, 224. A space 28 is defined in the retaining grooves 223, 224 to allow the base portion E1 to move in a radially outward direction. The buffer portion E2 is separated from the rod cover 6 or the piston 9 and projected toward the piston 9 or the head cover 5.

The pressure in the pressure chamber 10 increases when air is drawn in through the first port 3. This moves the piston 9 and the rod 8 to the left from the position shown in FIG. 24 and discharges air out of the pressure chamber 11 through the second port 4. The piston 9 is moved passing by the positions shown in FIGS. 27 (*a*), (*b*), and (*c*) until the piston 9 reaches the left stroke end position shown in FIG. 27(*d*). The operation of the cushion 325 during the movement will now be described.

FIG. 27(*a*) shows the piston 9 abut against the third section E23 of the cushion 25 when the piston 9 moves to the left. In this state, the sliding surface 327*a* of the base portion E1 is held in planar contact with the first wall G1 of the rod cover 6. Accordingly, the engagement between the third section E23 of the cushion 325 and the piston 9, and the engagement between the base portion E1 of the cushion 325 and the rod cover 6 maintains the outer side of the cushion 325 sealed from the inner side of the cushion 325.

Further movement of the piston 9 toward the left stroke end position from the above state starts elastic deformation of the cushion 325, as shown in FIG. 27(*b*). The contact between the seal circle P1 and the rod cover 6 maintains the outer side of the cushion 325 sealed from the inner side of the cushion 325. The piston 9 deforms and flexes the cushion 325 toward the rod cover 6. The resilient force of the cushion 325 acts in a direction opposite the moving direction of the piston 9 and thus absorbs the inertial force of the piston 9.

As shown in FIG. 27(*c*), continuous leftward movement of the piston 9 moves the base portion E1 of the cushion 325 in a radially outward direction until the movement of the base portion E1 becomes restricted by engagement with the third wall G3. The seal circle P2 of the cushion 325 contacts the rod cover 6. At this point, the first and second sections E21, E22 of the cushion 325 come into planar contact with the rod cover 6. This reinforces the sealing between the outer side and inner side of the cushion 325.

When the piston 9 reaches the left stroke end position as shown in FIG. 27(*d*), the pressing force of the piston 9 flexes the third section E23 of the cushion 325 toward the rod cover 6. The piston 9 stops when the substantially entire outer surface of the cushion 325 becomes flat.

As described above, the first seal circle P1 functions during the initial stage of the elastic deformation of the cushion 325 and the second seal circle P2 functions during the terminal state of the elastic deformation. Accordingly, higher sealing capability is obtained during elastic deformation of the cushion 325 in comparison with cushions having only one seal circle. The number of seal circles is not limited to two and may be further increased.

Once the base portion E1 abuts against the third wall G3, further movement of the cushion 325 in a radially outward direction becomes restricted. This restricts further movement of the first and second seal circles P1, P2. Accordingly, this suppresses wear of the cushion and enables the sealing ability to be maintained over a long period.

Furthermore, the elastic deformation of the cushion 325 occurs in a two stage manner. This enables extension of the cushion stroke and thus ensures superior impact absorbing ability.

Figure 28:
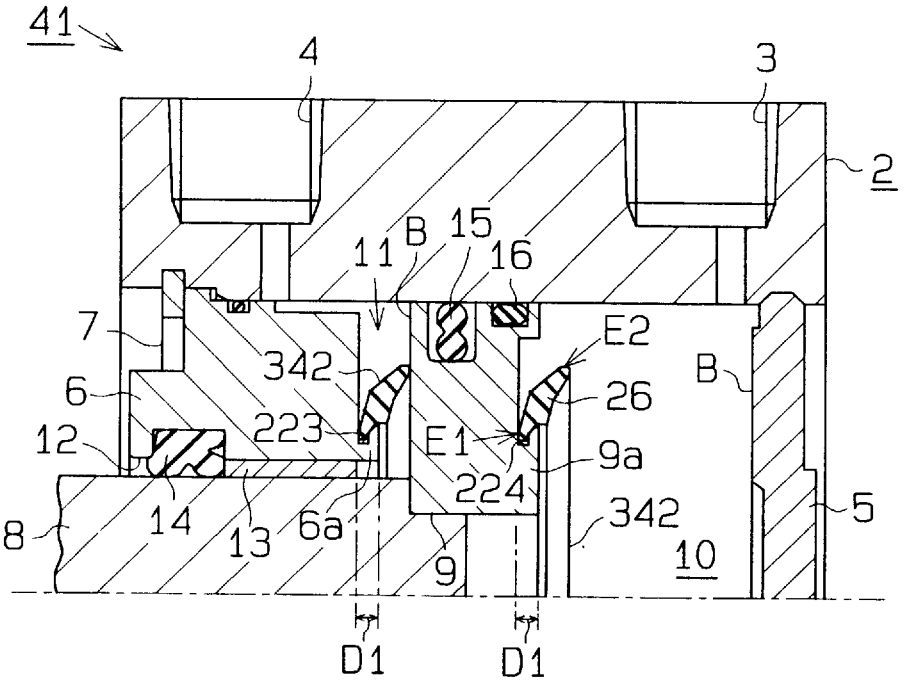
FIG. 28 is a partial cross-sectional view showing a fluid pressure cylinder according to a further embodiment;'
Figure 29:
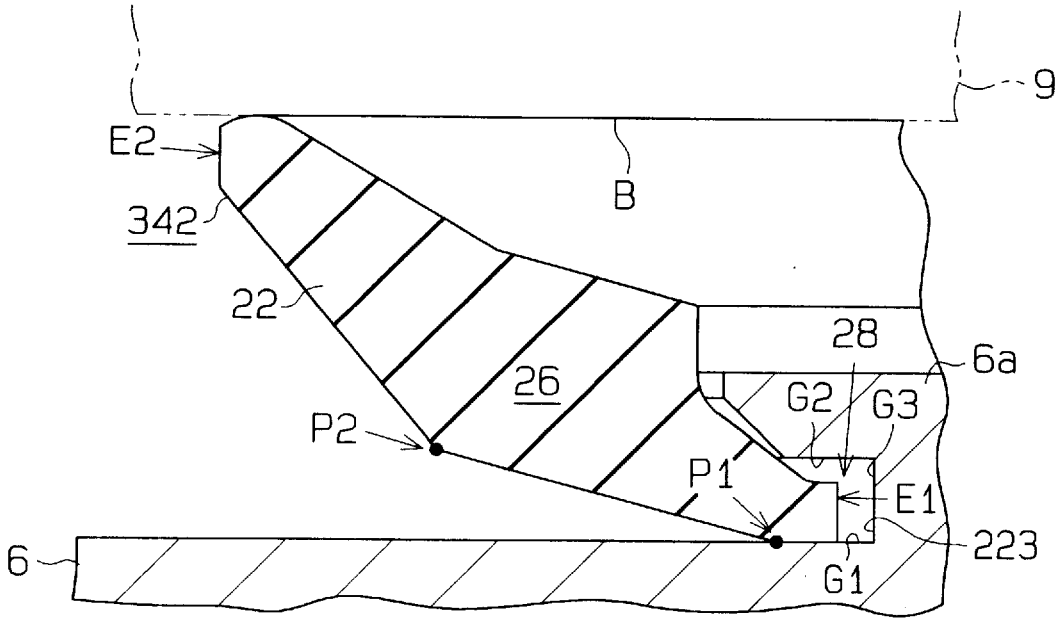
FIG. 29 is an enlarged partial cross-sectional view showing the cushion used in the cylinder of FIG. 28.

FIGS. 28 and 29 show a further embodiment. This form differs from the embodiment of FIG. 24 in that the base portion E1 is provided at the radially inner side of a cushion 342 while the buffer portion E2 is arranged at the radially outer side of the cushion 342. The attaching position of the cushion 342 is the same as the form illustrated in FIG. 4. Accordingly, this form is a combination of the embodiment illustrated in FIG. 24 and the embodiment illustrated in FIG. 4. Thus, the combined merits of these embodiments is obtained.

A further embodiment according to the present invention will now be described with reference to FIGS. 30 to 33. A fluid pressure cylinder 401 includes a cylinder body 402, a head cover 405, a rod cover 406, a piston 415, and a rod 416.

The piston 415 is slidably accommodated in the body 402. Pressure chambers 417, 418 are partitioned by the piston 415. A packing 421 is arranged about the periphery of the piston 415 to seal the pressure chambers 417, 418 from each other. The right pressure chamber 417 is connected with a recess 409 defined in the head cover 405.

One end of the rod 416 is screwed into the piston 416. The other end of the rod 416 projects outward from the cylinder 401 through the rod cover 406. A bearing 419 is defined in the rod cover 406 to decrease the sliding resistance between the rod 416 and the rod cover 406. A packing 420 is provided in the rod cover 406 to seal the space between the rod cover 406 and the body 402.

A first port 403 defined in the head cover 405 is connected to the right pressure chamber 417 by way of a passage 408. A second port 404 defined in the rod cover 406 is connected to the left chamber 418 by way of a passage 410. Thus, when air is sent into the right pressure chamber 417 through the first port 403, the piston 415 and the rod 416 are moved to the left, as viewed in FIG. 30. If air is sent into the left pressure chamber 418 through the second port 404, the piston 415 and the rod 416 are moved to the right, as viewed in FIG. 30.

Ring-like stoppers 429, which are made of a rigid material such as metal, are provided in the body 402. In this embodiment, each stopper 429 is made of aluminum and has an outer diameter that is substantially the same as the outer diameter of the piston 15. One stopper 429 is arranged at the inner side of the head cover 405 and the other stopper 429 is arranged at the inner side of the rod cover 406. When the piston 415 engages one of the stoppers 429, the movement of the piston 415 is restricted. An air guide groove 412 is provided for each stopper 429. The guide grooves 412 extend radially in the inner surface of the head cover 405 and the rod cover 406.

A projection 415*a* projects from the center of the right end of the piston 415. A fitting groove 428 is defined along the peripheral surface of the projection 415*a*. A cushion 425 is fit in the fitting groove 428 and on the rod 416 on each side of the piston 415. The cushions 425 are located adjacent to the piston 415.

Each cushion 425 has a round basal portion 426. The radially inner part of the basal portion 426 is in contact with the right or left surface of the piston 415. The surface facing the piston 415 at the radially outer part of the basal portion 426 is convex and separated from the piston 415. A slit 424 is provided in the radially outer part of the basal portion 426 of each cushion 425 to form a lip 427. The lips 427 are arranged opposed to the air guide grooves 412 that are provided in the head cover 405 and the rod cover 406.

Figure 30:
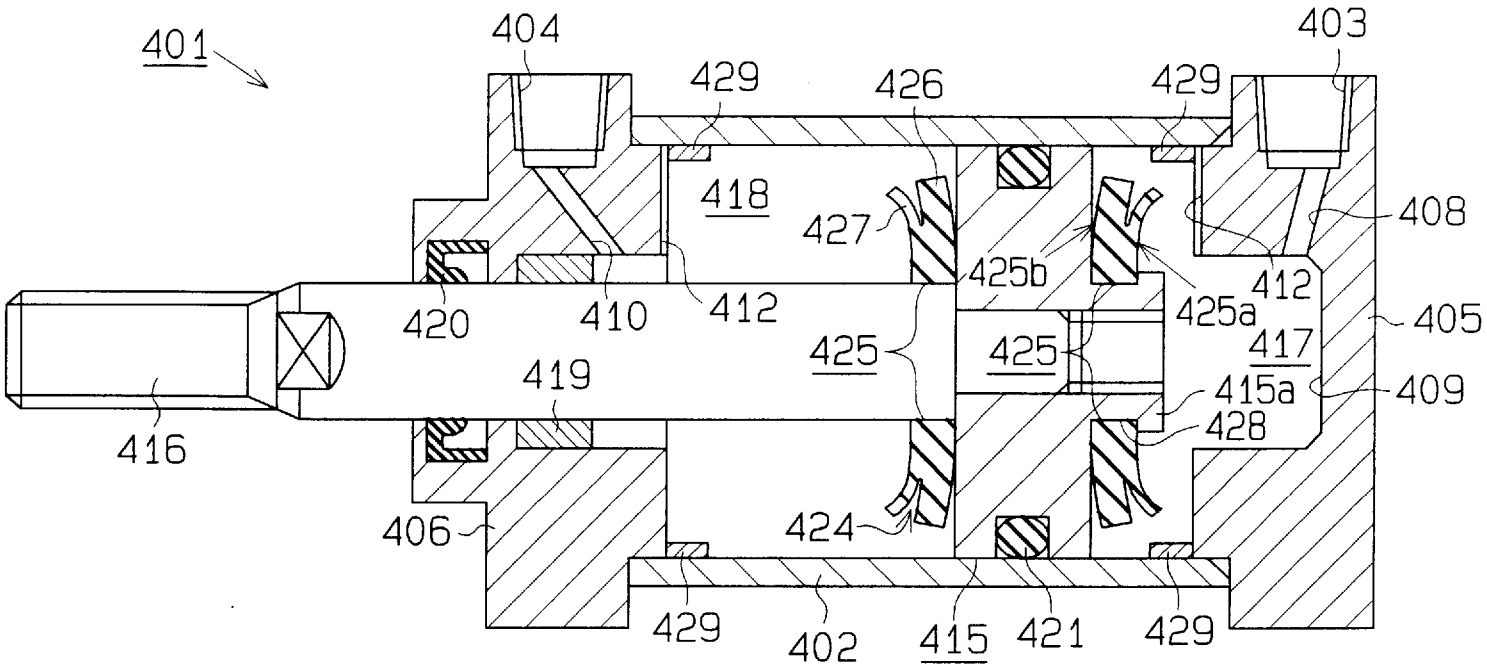
FIG. 30 is a cross-sectional view showing a fluid pressure cylinder according to a further embodiment of the present invention.

When air is supplied through the first port 403 with the piston 415 located at the head side stroke end position, the pressure in the head side pressure chamber 417 increases and moves the piston 415 and the rod 416 toward the left, as viewed in FIG. 30. This discharges the air in the rod side pressure chamber 418 externally through the second port 404.

If air is supplied through the second port 404, the pressure in the pressure chamber 18 increases and moves the piston 415 and the rod 416 to the right, as viewed in FIG. 30. This discharges the air in the head side pressure chamber 417 externally through the first port 403.

Figure 31:
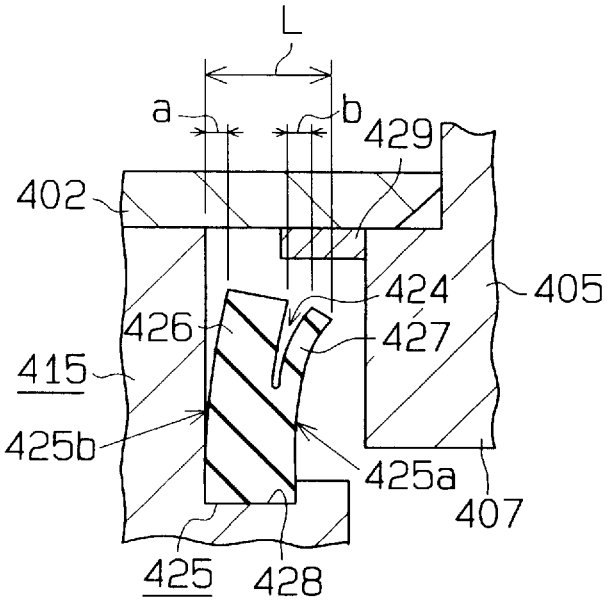
FIGS. 31(*a*) and 31(*b*) are enlarged partial cross-sectional views showing the operation of the cushion used in the cylinder of FIG. 30.
Figure 31:
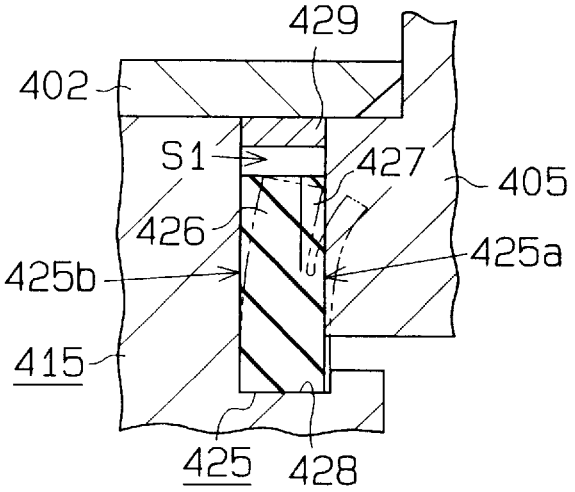

The movement of the piston 415 will now be described. As shown in FIG. 31(*a*), a first gap a becomes defined between the cushion 425 and the piston 415 and a second gap b becomes defined between the lip 427 and the basal portion 426 when the piston 415 moves away from the stroke end position. The gaps a and b are accounted for in the cushion stroke L of each cushion 425.

When air is drawn into the pressure chamber 418 and the piston 415 reaches a location near the right stroke end position, the lip 427 of the cushion 425 abuts against the inner surface of the head cover 405. In this state, the cushion 425 partitions the pressure chamber 417 into two spaces.

Among the two spaces, the space defined between an outer surface 425*a* of the cushion 425 and the head cover 405 is connected with the first port 403. The other space defined between the outer cylindrical surface of the cushion 425 and the body 402 is disconnected from the first port 403 and thus forms an air pocket S1.

When the piston 415 reaches the immediate vicinity of the stroke end position as shown in FIG. 31(*b*), the pressing force of the piston 415 elastically deforms the cushion 425. This abuts the lip 427 against the basal portion 426 and eliminates the second gap b. When the piston 415 reaches the stroke end position, the piston 415 presses the entire cushion 425 against the inner surface of the head cover 405. This compresses the entire cushion 425 and eliminates the first gap a. The movement of the piston 415 is stopped by engagement with the associated stopper 429.

After the movement of the piston 415 is stopped, air is charged into the pressure chamber 417. When the piston 415 starts to move in the opposite direction, the air in the pressure chamber 417 enters the air guide groove 412 and facilitates separation of the cushion 425 from the head cover 405.

In this embodiment, during elastic deformation and compression of the cushion 425, the resilient force of the cushion 425 acts in a direction opposite to the moving direction of the piston 415. The resilient force offsets the inertial force produced by the movement of the piston 415 and absorbs the impact produced when the piston 415 engages the stopper 429.

The volume of the air pocket S1 becomes smaller as the piston 415 approaches the stroke end position. This compresses the air in the air pocket S1.

Figure 35A:
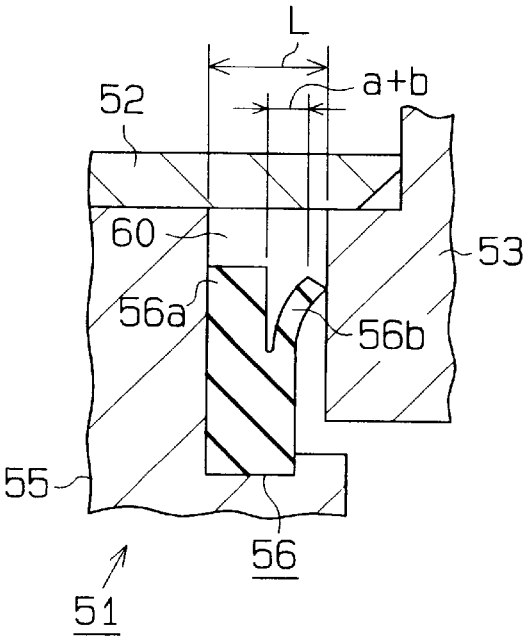
Fig.35(a) (Prior Art)
FIGS. 35(*a*) and 35(*b*) are partial enlarged cross-sectional views showing the operation of the cushion used in the cylinder of FIG. 34.
Figure 35B:
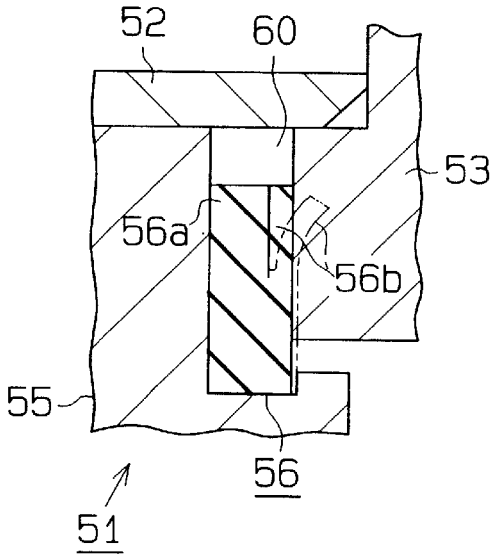
Fig.35(b) (Prior Art)

FIG. 35(*a*) shows a prior art cushion 56. To obtain the same cushion stroke L as is produced in the embodiment of FIG. 31(*a*), it is required that the prior art cushion 56 be provided with a gap between the lip 56*b* and the basal portion 56*a* that is equal to the sum of the distance of the gaps a, b of this embodiment. In this case, since the gap between the lip 56*b* and the basal portion 56*a* is wider than the gap between the lip 427 and the basal portion 426 of this embodiment, stress tends to concentrate at the basal end of the cushion 56*b*. This causes early deterioration of the cushion.

However, the embodiment of FIG. 31(*a*) has a gap between the lip 426 and the basal portion 426 that is more narrow than the gap of the cushion in the prior art. This improves the durability of the cushion.

The stopper 429 employed in the cylinder 401 is made of a rigid material such as metal. Thus, the stopper 429 differs from stoppers made of an elastic material in that the stopper 429 does not become deformed despite the application of impact. This, enhances the capability of the piston 415 to stop accurately at the stroke end position.

The stoppers 429 are fixed to the head cover 405 and the rod cover 406. This decreases the weight of the piston 415, which is a moving body, in comparison to the case in which the stoppers 429 are provided on the piston 415. Accordingly, the stoppers 429 do not interfere with the movement of the piston 415.

Figure 32:
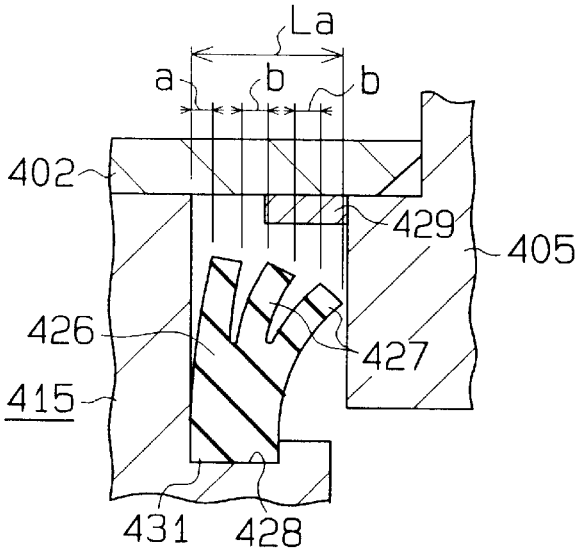
FIG. 32 is an enlarged partial cross-sectional view showing a fluid pressure cylinder according to a further embodiment.

The embodiment of FIG. 30 may be modified in the forms described below. As shown in FIG. 32, two lips 427 may be provided at the circumferential section of the basal portion 426. In this case, the cushion stroke La, which accounts for the gaps a, b, and c that are defined between the lips, is greater than the cushion stroke L of the fifth embodiment. This structure disperses stress at the basal ends of the lips. If the cushion is provided solely with a single lip 427, stress concentrates on the lip 427. Thus, the deterioration of the cushion 431 is further suppressed by providing two lips 427. Furthermore, the cushion 431 may be provided with three or more lips 427.

Figure 33A:
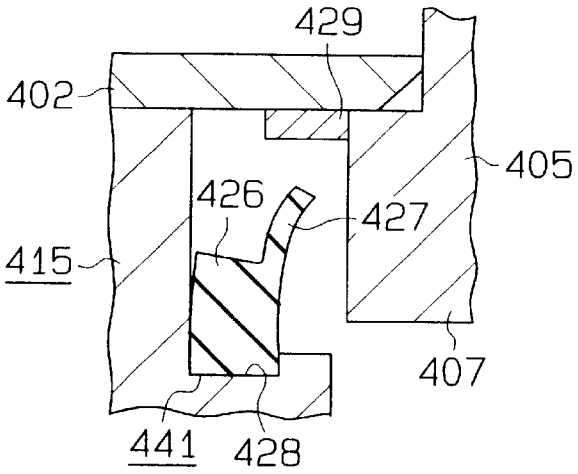
FIG. 33(*a*) is a partial enlarged cross-sectional view showing a fluid pressure cylinder according to a further embodiment.
Figure 33B:
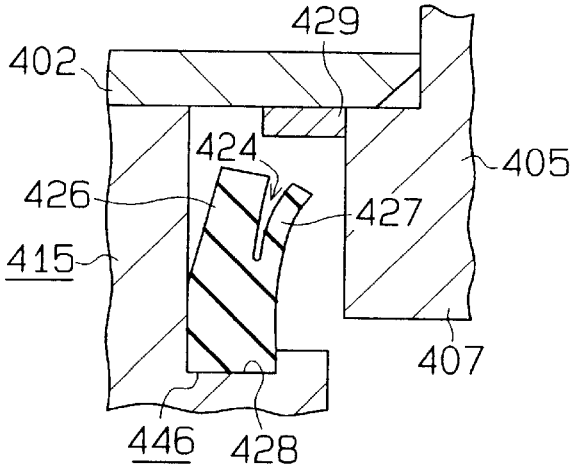
Figure 34:
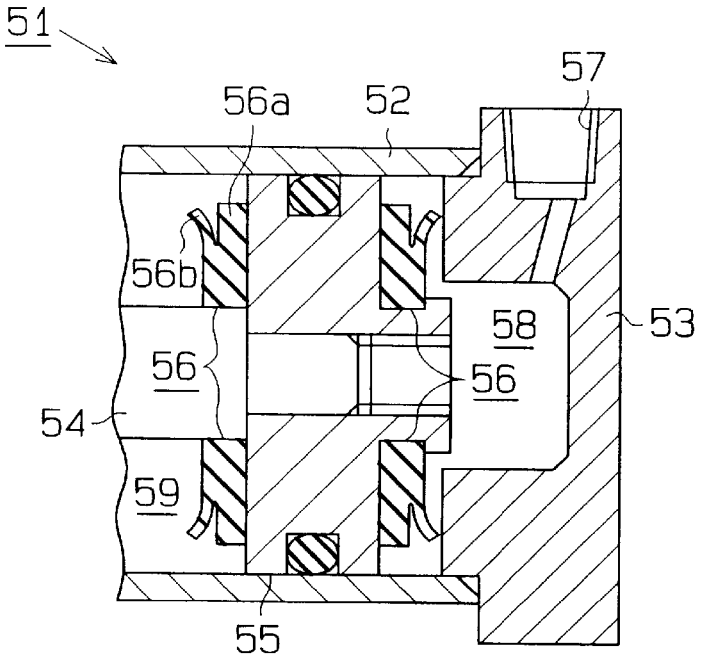
Fig.34 (Prior Art)
FIG. 34 is a partial cross-sectional view partially showing a prior art fluid pressure cylinder.

As shown in FIG. 33(*a*), the outer diameter of the basal portion 426 may be smaller than the outer diameter of the lip 427. As shown in FIG. 33(*b*), a cushion 446 may have a surface facing the piston that is flat.

The material of the stoppers 429 is not limited to aluminum. Other type of metals or ceramic may be used as the material of the stoppers 429. The shape of the stoppers 429 need not be annular. The stoppers 428 may also be positioned at any location on the inner surface of the cylinder body 402 or on the end surfaces of the piston 415. If it is not required that the piston 415 stop accurately at the stroke end position, the stoppers 429 may be omitted from the structure of the cylinder 401.

The stoppers 429 may be formed integrally on the inner end surfaces of the head cover 405 and the rod cover 406. This facilitates assembly of the cylinder in comparison to when the stoppers 429 are individual parts.

Slits may be provided in the inner circumferential surface of the cushion 425 to form lips. Either one or both cushions may be provided on the head and rod covers. The cushions 425 may be made of a resin material other than rubber.

Although several embodiments of the present invention have been described herein, it should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope of the appended claims.

What is claimed is:

1. A fluid pressure cylinder comprising:

a cylinder body having a closed space therein;

a piston slidably accommodated in the cylinder body to divide the closed space into first and second pressure chambers;

means for supplying fluid to each chamber such that the piston reciprocates between a first stroke end and a second stroke end by receiving fluid in one of the first and second pressure chambers;

a rod connected to the piston, wherein the rod extends from the cylinder body;

first and second bumper surfaces, one of the first and second bumper surfaces being fixed to the piston and the other being fixed to the cylinder such that the bumper surfaces face each other, wherein the bumper surfaces approach each other when the piston reaches the first stroke end and separate from one another when the piston moves toward the second stroke end, and wherein the bumper surface that is fixed to the cylinder limits movement of the piston and determines the position of the first stroke end;

an annular cushion retainer connected to the first bumper surface;

a ring-like, elastomeric cushion located between the first and second bumper surfaces for deforming and cushioning an impact produced when the piston reaches the first stroke end, the cushion having a shape corresponding generally to a hollow conical section, the cushion including:

a base section that is retained by the cushion retainer so that the cushion is retained in close proximity to the first bumper surface;

a buffer section joined to the base section, the buffer section being spaced from the first bumper surface, the buffer section having an outer surface for contacting the second bumper surface and an inner surface that faces the first bumper surface, the outer surface forming a circular seal with the second bumper surface when the piston approaches the first stroke end, and wherein the circular seal creates a sealed fluid pocket that acts to further cushion the impact, wherein the cushion is flexed such that the buffer section moves toward the first bumper surface against its elasticity when the piston approaches the first stroke end, and wherein the buffer section moves away from the first bumper surface due to its elasticity when the piston moves from the first stroke end towards the second stroke end.

2. The fluid pressure cylinder according to claim 1, wherein the retainer allows the base section to move with respect to the first bumper surface when the cushion is deformed.

3. The fluid pressure cylinder according to claim 1, wherein the base section is located at an inner periphery of the ring and the buffer section is located radially outward of the base section.

4. The fluid pressure cylinder according to claim 1, wherein the base section is located at an outer periphery of the ring and the buffer section is located radially inward of the base section.

5. The fluid pressure cylinder according to claim 2, wherein the thickness of the buffer section is substantially equal to that of the base section.

6. The fluid pressure cylinder according to claim 1, wherein the cushion retainer is an annular groove.

7. The fluid pressure cylinder according to claim 6, wherein the annular groove has an inner wall surface that is continuous with the first bumper surface.

8. The fluid pressure cylinder according to claim 6, wherein the annular groove includes a conical surface that is coaxial with the cylinder, wherein the cushion fully contacts the conical surface when the cushion is not deformed.

9. The fluid pressure cylinder according to claim 6, wherein the annular groove faces radially outward.

10. The fluid pressure cylinder according to claim 6, wherein the annular groove faces radially inward.

11. A fluid pressure cylinder comprising:

a cylinder body having a closed space therein;

a piston slidably accommodated in the cylinder body to divide the closed space into first and second pressure chambers;

means for supplying fluid to each chamber such that the piston reciprocates between a first stroke end and a second stroke end by receiving fluid in one of the first and second pressure chambers;

a rod connected to the piston, wherein the rod extends from the cylinder body;

first and second bumper surfaces, one of the first and second bumper surfaces being fixed to the piston and the other being fixed to the cylinder such that the bumper surfaces face each other, wherein the bumper surfaces approach each other when the piston reaches the first stroke end and separate from one another when the piston moves toward the second stroke end, and wherein the bumper surface that is fixed to the cylinder limits movement of the piston and determines the position of the first stroke end;

a cushion retainer connected to the first bumper surface;

an elastomeric cushion located between the first and second bumper surfaces for preventing direct contact between the bumper surfaces when the piston reaches the first stroke end, the cushion including:

a base section that is retained by the cushion retainer so that the cushion is retained in close proximity to the first bumper surface;

a buffer section joined to the base section, the buffer section having an inner surface for contacting the first bumper surface and an outer surface, which is opposite to the inner surface, for contacting the second bumper surface, wherein the buffer section is squeezed by the first and second bumper surfaces when the piston reaches the first stoke end thereby forming a sealed fluid pocket oriented to absorb an impact of said second bumper surface, and wherein the cushion is constructed such that the buffer section takes a normal position, in which the buffer section is spaced apart from the first bumper surface, when the outer surface of the buffer section is not contacted by the second bumper surface, and wherein the buffer section is moved toward the first bumper surface against the elasticity of the cushion when the outer surface of the buffer section is contacted by the second bumper surface as the piston approaches the first stroke end, and wherein the elasticity of the cushion causes the buffer section to return to the normal position when the piston moves toward the second stroke end.

12. The fluid pressure cylinder according to claim 11, wherein the cushion is formed in the shape of a ring.

13. The fluid pressure cylinder according to claim 12, wherein the base section is located at an inner periphery of the ring and the buffer section is located radially outward of the base section.

14. The fluid pressure cylinder according to claim 12, wherein the base section is located at an outer periphery of the ring and the buffer section is located radially inward of the base section.

15. The fluid pressure cylinder according to claim 12, wherein the thickness of the buffer section is greater than the thickness of the base section.

16. The fluid pressure cylinder according to claim 11, wherein the cushion retainer is an annular groove.

17. The fluid pressure cylinder according to claim 16, wherein the annular groove has an inner wall surface that is continuous with the first bumper surface.

18. The fluid pressure cylinder according to claim 16, wherein the annular groove includes an annular surface that is inclined with respect to the axis of the cylinder, wherein the cushion fully contacts the inclined surface when the cushion is in its normal position.

19. The fluid pressure cylinder according to claim 16, wherein the annular groove faces radially outward.

20. The fluid pressure cylinder according to claim 16, wherein the annular groove faces radially inward.

21. The fluid pressure cylinder according to claim 11, wherein the cushion has a plurality of slits for preventing wrinkles from forming on the cushion when the cushion is elastically deformed.

22. The fluid pressure cylinder according to claim 11, wherein the cushion retainer engages the second bumper surface when the piston reaches the first stroke end and after the buffer section of the cushion has deformed by a predetermined amount.

23. The fluid pressure cylinder according to claim 11, wherein the retainer is constructed to allow the base section to move radially when the cushion is squeezed by the bumper surfaces.

24. The fluid pressure cylinder according to claim 11, wherein the cushion has a lip extending therefrom.

25. The fluid pressure cylinder according to claim 12, wherein the shape of the cushion is generally in the form of a hollow conical section.

26. The fluid pressure cylinders according to claim 11, wherein the base sect ion is loosely retained by the retainer.

27. A fluid pressure cylinder comprising:

a cylinder body having a closed space therein;

a piston slidably accommodated in the cylinder body to divide the closed space into first and second pressure chambers;

means for supplying fluid to each chamber such that the piston reciprocates between a first stoke end and a second stoke end by receiving fluid in one of the first and second pressure chambers;

a rod connected to the piston, wherein the rod extends from the cylinder body;

first and second bumper surfaces, one of the first and second bumper surfaces being fixed to the piston and the other being fixed to the cylinder such that the bumper surfaces face each other, wherein the bumper surfaces approach each other when the piston reaches the first stoke end and separate from one another when the piston moves toward the second stoke end, and wherein the bumper surface that is fixed to the cylinder limits movement of the piston and determines the position of the first stoke end;

a cushion retainer connected to the first bumper surface;

an elastomeric cushion located between the first and second bumper surfaces for preventing direct contact between the bumper surfaces when the piston reaches the first stoke end, the cushion including:

a base section that is retained by the cushion retainer so that the cushion is retained in close proximity to the first bumper surface;

a buffer section joined to the base section, the buffer section having an inner surface for contacting the first bumper surface and an outer surface which is opposite to the inner surface, for contacting the second bumper surface, wherein the buffer section is squeezed by the first and second bumper surfaces when the piston reaches the first stoke end, and wherein the cushion is constructed such that the buffer section takes a normal position, in which the buffer section is spaced apart from the first bumper surface, when the outer surface of the buffer section is not contacted by the second bumper surface, and wherein the buffer section is moved toward the first bumper surface against the elasticity of the cushion when the outer surface of the buffer section is contacted by the second bumper surface as the piston approaches the first stroke end, and wherein the elasticity of the cushion causes the buffer section to return to the normal position when the piston moves toward the second end;

wherein the buffer section includes:

a first section connected to the base section, wherein the first section has a thickness that increases toward the center of each cushion;

a second portion connected to the first portion, wherein the second portion has a uniform thickness; and a third portion connected to the second portion, wherein the third portion has a thickness that decreases toward the center of each cushion.

28. The fluid pressure cylinder according to claim 27, wherein each cushion further comprises:

a first sealing line located between the base section and the first portion for forming a seal at an initial stage of the elastic deformation of each cushion; and a second sealing line located between the first portion and the second portion for enhancing the seal at a final stage of the elastic deformation of each cushion.

* * * * *